US011142854B2

(12) United States Patent
Lucas Gaus et al.

(10) Patent No.: US 11,142,854 B2
(45) Date of Patent: Oct. 12, 2021

(54) UPPER-TORSO GARMENT WITH THREE-DIMENSIONAL KNIT STRUCTURES

(71) Applicant: NIKE, Inc., Beaverton, OR (US)

(72) Inventors: Vanessa L. Lucas Gaus, Aloha, OR (US); Virginia Meckley, Hillsboro, OR (US); Paul R. Montgomery, Portland, OR (US); Nicole Rendone, Beaverton, OR (US); Samantha E. G. Woodard, Portland, OR (US); Jesse L. Burton, Portland, OR (US)

(73) Assignee: NIKE, INC., Beaverton, OR (US)

( * ) Notice: Subject to any disclaimer, the term of this patent is extended or adjusted under 35 U.S.C. 154(b) by 119 days.

(21) Appl. No.: 16/576,244

(22) Filed: Sep. 19, 2019

(65) Prior Publication Data

US 2020/0109496 A1 Apr. 9, 2020

Related U.S. Application Data

(60) Provisional application No. 62/740,613, filed on Oct. 3, 2018.

(51) Int. Cl.
*D04B 1/24* (2006.01)
*D04B 1/10* (2006.01)

(52) U.S. Cl.
CPC ..... *D04B 1/246* (2013.01); *D04B 1/108* (2013.01); *D10B 2403/0331* (2013.01)

(58) Field of Classification Search
CPC ..... D04B 1/108; D04B 1/246; D04B 1/102; D04B 9/08; A41C 3/0057; A41C 3/0014
See application file for complete search history.

(56) References Cited

U.S. PATENT DOCUMENTS

| | | | |
|---|---|---|---|
| 1,948,670 | A | 2/1934 | Mueller |
| 1,984,326 | A | 12/1934 | Titone |
| 2,121,489 | A | 6/1938 | Rutledge et al. |
| 2,397,247 | A | 3/1946 | Davidson |
| 2,707,381 | A | 5/1955 | Lombardi |
| 2,899,812 | A | 8/1959 | Attenborough |
| 2,946,211 | A | 7/1960 | Morancy |
| 3,092,987 | A | 6/1963 | Levine |
| 3,167,938 | A | 2/1965 | Seiler |
| 3,241,340 | A | 3/1966 | Knohl |
| 3,389,580 | A | 6/1968 | Bentley et al. |
| 3,500,665 | A | 3/1970 | Braxton et al. |
| 3,537,279 | A | 11/1970 | Epley |

(Continued)

FOREIGN PATENT DOCUMENTS

| | | | |
|---|---|---|---|
| CN | 1181428 | A | 5/1998 |
| CN | 1465303 | A | 1/2004 |

(Continued)

OTHER PUBLICATIONS

Office Action received for Sri Lankan Patent Application No. 20760, dated Dec. 28, 2020, 1 page.

(Continued)

*Primary Examiner* — Danny Worrell
(74) *Attorney, Agent, or Firm* — Shook, Hardy & Bacon L.L.P.

(57) ABSTRACT

An upper-torso garment includes a chest-covering portion having a knit textile region, which includes a plurality of courses fully spanning a dome-shaped portion. In addition, the knit textile region includes a plurality of partial-length courses partially spanning the dome-shaped portion.

18 Claims, 7 Drawing Sheets

(56) References Cited

U.S. PATENT DOCUMENTS

| | | | |
|---|---|---|---|
| 3,561,234 | A | 2/1971 | Mishcon et al. |
| 3,640,096 | A | 2/1972 | Betts et al. |
| 3,668,896 | A | 6/1972 | Betts et al. |
| 3,668,898 | A | 6/1972 | Betts et al. |
| 3,677,252 | A | 7/1972 | Pedley |
| 3,695,063 | A | 10/1972 | Betts et al. |
| 3,789,098 | A | 1/1974 | Cole et al. |
| 3,796,068 | A | 3/1974 | Betts et al. |
| 3,985,003 | A | 10/1976 | Reed |
| 4,019,350 | A | 4/1977 | Schmidt |
| 4,100,766 | A | 7/1978 | Kuhnert |
| 4,267,710 | A | 5/1981 | Imamichi |
| 4,311,150 | A | 1/1982 | Schreiber et al. |
| 4,356,710 | A | 11/1982 | Mizuno et al. |
| 4,419,997 | A | 12/1983 | Cole et al. |
| 5,120,264 | A | 6/1992 | Van Engel |
| 5,214,941 | A | 6/1993 | Essig |
| 5,359,865 | A | 11/1994 | So |
| 5,787,503 | A | 8/1998 | Murphy, III |
| 5,887,451 | A | 3/1999 | Suzuki |
| 5,890,381 | A | 4/1999 | Leeke et al. |
| 5,916,272 | A | 6/1999 | Nonnenmacher et al. |
| 5,946,944 | A | 9/1999 | Osborne |
| 5,956,765 | A | 9/1999 | Chin |
| 6,089,052 | A | 7/2000 | Riegger |
| 6,178,784 | B1 | 1/2001 | Marley |
| 6,443,805 | B1 | 9/2002 | Kirkwood |
| 6,526,783 | B2 | 3/2003 | Sheu |
| 6,550,286 | B2 | 4/2003 | Querquant |
| 6,645,040 | B2 | 11/2003 | Rabinowicz et al. |
| 6,685,534 | B2 | 2/2004 | Mitchell et al. |
| 6,779,367 | B2 | 8/2004 | Mitchell et al. |
| 6,779,369 | B2 | 8/2004 | Shepherd |
| 6,824,445 | B2 | 11/2004 | Oneyear et al. |
| 6,899,591 | B2 | 5/2005 | Mitchell |
| RE38,853 | E | 10/2005 | Rabinowicz |
| 7,001,240 | B1 | 2/2006 | Huffman-Jimenez |
| 7,043,329 | B2 | 5/2006 | Dias et al. |
| 7,169,011 | B2 | 1/2007 | Mitchell et al. |
| 7,442,110 | B2 | 10/2008 | Gaudet et al. |
| 7,536,879 | B2 | 5/2009 | Vanwelden |
| 7,611,999 | B2 | 11/2009 | McMurray |
| 7,614,256 | B2 | 11/2009 | Mitchell |
| 7,716,954 | B2 | 5/2010 | Naka et al. |
| 8,128,457 | B2 | 3/2012 | Reinisch et al. |
| 8,226,452 | B2 | 7/2012 | Hendrickson |
| 8,398,453 | B2 | 3/2013 | Mitchell et al. |
| 8,469,769 | B2 | 6/2013 | Hendrickson |
| 8,550,872 | B2 | 10/2013 | Upton et al. |
| 8,640,503 | B2 | 2/2014 | Kunde et al. |
| 8,690,634 | B2 | 4/2014 | Heath et al. |
| 8,899,591 | B1 | 12/2014 | Donaldson |
| 9,198,467 | B2 | 12/2015 | Gordon |
| 9,375,045 | B2 | 6/2016 | Farris et al. |
| 9,375,046 | B2 | 6/2016 | Meir |
| 9,405,205 | B2 | 8/2016 | De Graaf et al. |
| 9,538,794 | B2 | 1/2017 | Turlan |
| 10,145,042 | B2 | 12/2018 | Diaz et al. |
| 10,179,960 | B2 | 1/2019 | Diaz et al. |
| 10,415,164 | B2 | 9/2019 | Diaz et al. |
| 2004/0097151 | A1 | 5/2004 | McMurray |
| 2004/0099016 | A1 | 5/2004 | Shepherd |
| 2004/0168479 | A1 | 9/2004 | McMurray |
| 2005/0115282 | A1 | 6/2005 | Starbuck |
| 2005/0255789 | A1 | 11/2005 | Gaudet et al. |
| 2006/0243000 | A1 | 11/2006 | Turlan et al. |
| 2007/0238392 | A1 | 10/2007 | Starbuck et al. |
| 2008/0268217 | A1 | 10/2008 | Kanatani et al. |
| 2010/0184355 | A1 | 7/2010 | Kennedy |
| 2014/0068968 | A1 | 3/2014 | Podhajny et al. |
| 2014/0366585 | A1 | 12/2014 | Shen et al. |
| 2016/0242472 | A1 | 8/2016 | Turlan |
| 2016/0251782 | A1 | 9/2016 | Liao et al. |
| 2017/0119063 | A1 | 5/2017 | Diaz et al. |
| 2018/0317568 | A1 | 11/2018 | Diaz et al. |
| 2018/0317569 | A1 | 11/2018 | Diaz et al. |
| 2018/0317570 | A1 | 11/2018 | Diaz et al. |
| 2018/0320297 | A1 | 11/2018 | Diaz et al. |
| 2019/0055683 | A1 | 2/2019 | Diaz et al. |
| 2019/0297956 | A1 | 10/2019 | Diaz et al. |
| 2019/0345653 | A1 | 11/2019 | Diaz et al. |

FOREIGN PATENT DOCUMENTS

| | | | |
|---|---|---|---|
| CN | 1833059 | A | 9/2006 |
| CN | 101313096 | A | 11/2008 |
| CN | 102657384 | A | 9/2012 |
| CN | 102770036 | A | 11/2012 |
| CN | 103046216 | A | 4/2013 |
| CN | 104131399 | A | 11/2014 |
| DE | 2036542 | A1 | 2/1972 |
| EP | 0261800 | A2 | 3/1988 |
| EP | 1449946 | A1 | 8/2004 |
| EP | 2952616 | A1 | 12/2015 |
| GB | 1574736 | A | 9/1980 |
| JP | 7-138850 | A | 5/1995 |
| JP | 3039099 | U | 6/1997 |
| JP | 10-24799 | A | 1/1998 |
| JP | 11-36106 | A | 2/1999 |
| JP | 2002-339206 | A | 11/2002 |
| JP | 2003-500558 | A | 1/2003 |
| JP | 2003-147607 | A | 5/2003 |
| JP | 2005-533197 | A | 11/2005 |
| JP | 2006-283250 | A | 10/2006 |
| JP | 2007-31849 | A | 2/2007 |
| JP | 2008-169533 | A | 7/2008 |
| JP | 2009-270216 | A | 11/2009 |
| JP | 2012-072513 | A | 4/2012 |
| JP | 3175485 | U | 5/2012 |
| JP | 2013-213304 | A | 10/2013 |
| JP | 5361320 | A | 12/2013 |
| JP | 2014-231665 | A | 12/2014 |
| KR | 96-16088 | U | 6/1996 |
| KR | 2001-0102182 | A | 11/2001 |
| KR | 2001-0112492 | A | 12/2001 |
| KR | 10-2014-0130027 | A | 11/2014 |
| TW | 201249358 | A | 12/2012 |
| TW | I479059 | B | 4/2015 |
| TW | I618828 | B | 3/2018 |
| WO | 00/71794 | A1 | 11/2000 |
| WO | 2005041702 | A2 | 5/2005 |
| WO | 2011106014 | A1 | 9/2011 |
| WO | 2012/063316 | A1 | 5/2012 |
| WO | 2016197051 | A1 | 12/2016 |

OTHER PUBLICATIONS

International Preliminary Report on Patentability dated Nov. 14, 2019 in International Patent Application No. PCT/US2017/030859, 9 pages.

International Preliminary Report on Patentability dated Nov. 14, 2019 in International Patent Application No. PCT/US2017/030947, 9 pages.

International Preliminary Report on Patentability dated Nov. 14, 2019 in International Patent Application No. PCT/US2017/030861, 9 pages.

International Preliminary Report on Patentability dated Nov. 14, 2019 in International Patent Application No. PCT/US2017/030863, 8 pages.

Zheng, Rong, Winnie Yu, and Jintu Fan, "Pressure evaluation of 3D seamless knitted bras and conventional wired bras," Fibers and Polymers 10.1 (2009): 124-131. http://www.researchgate.net/profile/Winnie_Yu/publication/225481465_Pressure_evaluation_of_3D_seamless_knitted_bras_and_conventional_wired_bras/links/54d029160cf24601c0964062.pdf.

"Leading Lady Seamless Knit Nursing Bra," Hanes®, hanes.com, Style #24304, accessed Oct. 12, 2015 http://www.hanes.com/hanes/onehanesplace/bra/shop-by-category/nursing-bras/leading-lady-nursing-bra-24304.

Simplicity Mother's Breast Feeding Maternity Nursing Bra Tank Top Camisole, Amazon, amazon.com, Accessed Oct. 2015 http://

(56) References Cited

OTHER PUBLICATIONS www.amazon.com/Simplicity%C2%AE-Womens-Maternity-Nursing-Sleeveless/dp/B00LQ1O8FK.
STOLL Performance Plus SS-2016-ES Brochure, © 2016 H. STOLL AG & Co., KG, Germany, 36 pages.
"Breast sizing and development of 3D seamless bra"; Rong Zheng; 2007 http://ira.lib.polyu.edu.hk/handle/10397/2619.
"Three Dimensional Seamless Garment Knitting On VBedFlat Knitting Machines"; Wonseok Choi et al. https://www.researchgate.net/publication/237482349_Three_dimensional_seamless_garment_knitting_on_V-bed_flat_knitting_machines.
Office Action received for Sri Lankan Patent Application No. 20761, dated Nov. 30, 2020, 1 page.
Notice of Allowance received for U.S. Appl. No. 16/523,017, dated Nov. 3, 2020, 5 pages.
Office Action received for Canadian Patent Application No. 3054723, dated Oct. 16, 2020, 3 pages.
Office Action received for Canadian Patent Application No. 3054797, dated Oct. 16, 2020, 3 pages.
Office Action received for Canadian Patent Application No. 3054919, dated Oct. 28, 2020, 3 pages.
Office Action received for Canadian Patent Application No. 3055024, dated Oct. 28, 2020, 3 pages.
Non-Final Office Action received for U.S. Appl. No. 16/523,017, dated Jul. 23, 2020, 7 pages.
Notice of Allowance received for U.S. Appl. No. 15/584,938, dated Aug. 6, 2020, 8 pages.
Office Action received for European Patent Application No. 16805575.4, dated Aug. 17, 2020, 5 pages.
Final Office Action received for U.S. Appl. No. 15/584,938, dated Jan. 16, 2020, 7 pages.
International Search Report and Written Opinion received for PCT Patent Application No. PCT/US2019/052592, dated Dec. 16, 2019, 14 pages.
Notice of Allowance received for U.S. Appl. No. 16/166,378, dated Dec. 11, 2019, 5 pages.
Office Action received for Sri Lankan Patent Application No. 19856, dated Dec. 16, 2019, 1 page.
Notice of Allowance received for Canadian Patent Application No. 3055024, dated Jun. 10, 2021, 1 page.
Office Action received for Canadian Patent Application No. 3054919, dated Jun. 22, 2021, 3 pages.
Notice of Allowance received for U.S. Appl. No. 16/786,065, dated May 25, 2021, 6 pages.
International Preliminary Report on Patentability received for PCT Patent Application No. PCT/US2019/052592, dated Apr. 15, 2021, 8 pages.
Notice of Allowance received for Canadian Patent Application No. 3,054,797, dated May 3, 2021, 1 page.
Notice of Allowance received for Canadian Patent Application No. 3054723, dated May 4, 2021, 1 page.
Office Action received for Canadian Patent Application No. 3004052, dated May 5, 2021, 3 pages.

UPPER-TORSO GARMENT WITH THREE-DIMENSIONAL KNIT STRUCTURES

CROSS-REFERENCE TO RELATED APPLICATIONS

This application, having attorney docket number 331269/180226US02 and entitled "Upper-Torso Garment with Three-Dimensional Knit Structures," claims the benefit of priority of U.S. Prov. App. No. 62/740,613, entitled "Upper-Torso Garment with Three-Dimensional Knit Structures," and filed Oct. 3, 2018. The entirety of the aforementioned application is incorporated by reference herein.

TECHNICAL FIELD

This disclosure relates to an upper-torso garment, at least a portion of which includes a three-dimensional knit structure.

BACKGROUND

Upper-torso garments typically include various parts configured to cover an upper-torso region of a wearer. For example, upper-torso garments often include a chest-covering portion and a back-covering portion. In addition, upper-torso garments may include various textiles and material types, which are sometimes selected based on various properties. An example of one type of textile that may have various properties and that may be used to construct at least part of an upper-torso garment is a knit textile.

BRIEF DESCRIPTION OF THE DRAWINGS

The subject matter of this disclosure is described in detail herein with reference to the attached figures, which are incorporated herein by reference.

DETAILED DESCRIPTION

The subject matter of the present disclosure is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

At a high level, this disclosure describes an upper-torso garment having various elements that contribute to the operation of the garment, both independently of, and in combination with, one another. In one aspect, the upper-torso garment includes three-dimensionally-knit (3D-knit) domed portions configured to cover different regions of a wearer's body, such as a breast region. The 3D-knit domed portions might include various knit structures, and in one instance, the 3D-knit domed portions include partial-length knit rows. Other elements may also affect the properties of the garment, including (but not limited to) the yarn composition and yarn size, additional knit structures, and stitch size, which will be described in more detail in other parts of this disclosure. For instance, in one aspect, the 3D-knit domed portions (including the partial-length knit rows) are constructed of a double-knit fabric having a front knit layer and a back knit layer coupled by a binder yarn. In a further aspect, the front knit layer, the back knit layer, and the binder yarn each include an elastic yarn, and these properties, in combination with an arrangement of partial-length knit courses, collectively function to provide an amount of support to a wearer's body. These and other aspects will be described in more detail with reference to the figures.

Figure 1:
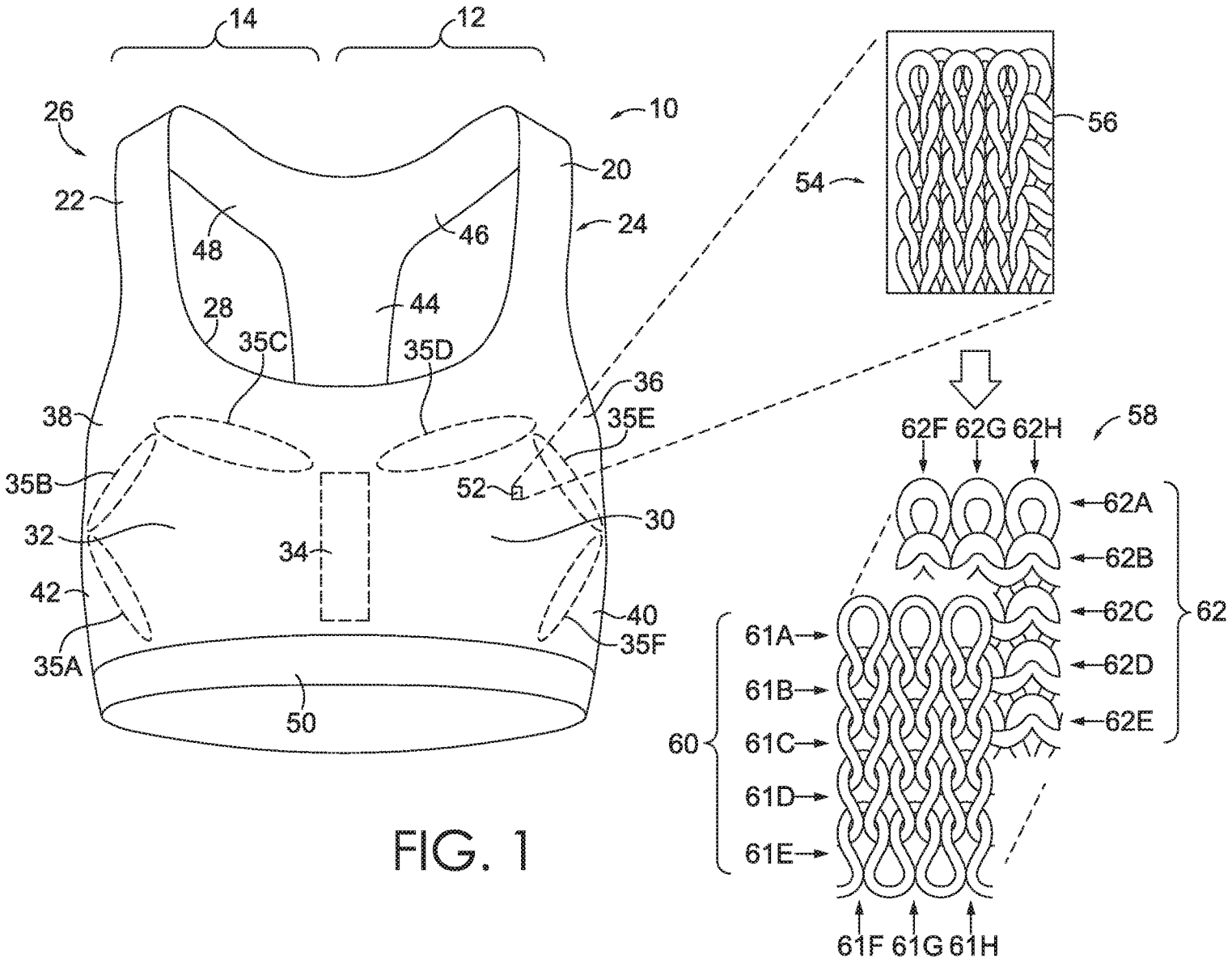
FIG. 1 depicts a front view of an upper-torso garment in accordance with an aspect of this disclosure.
Figure 3:
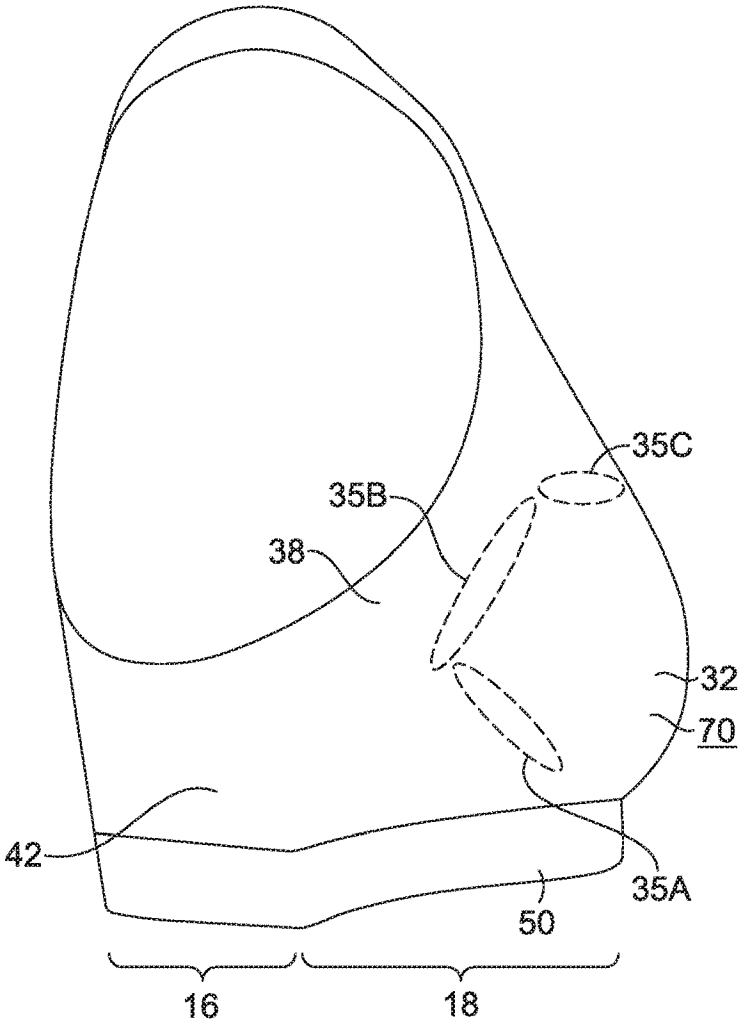
FIG. 3 depicts a side view of the garment depicted in FIG. 1.
Figure 2:
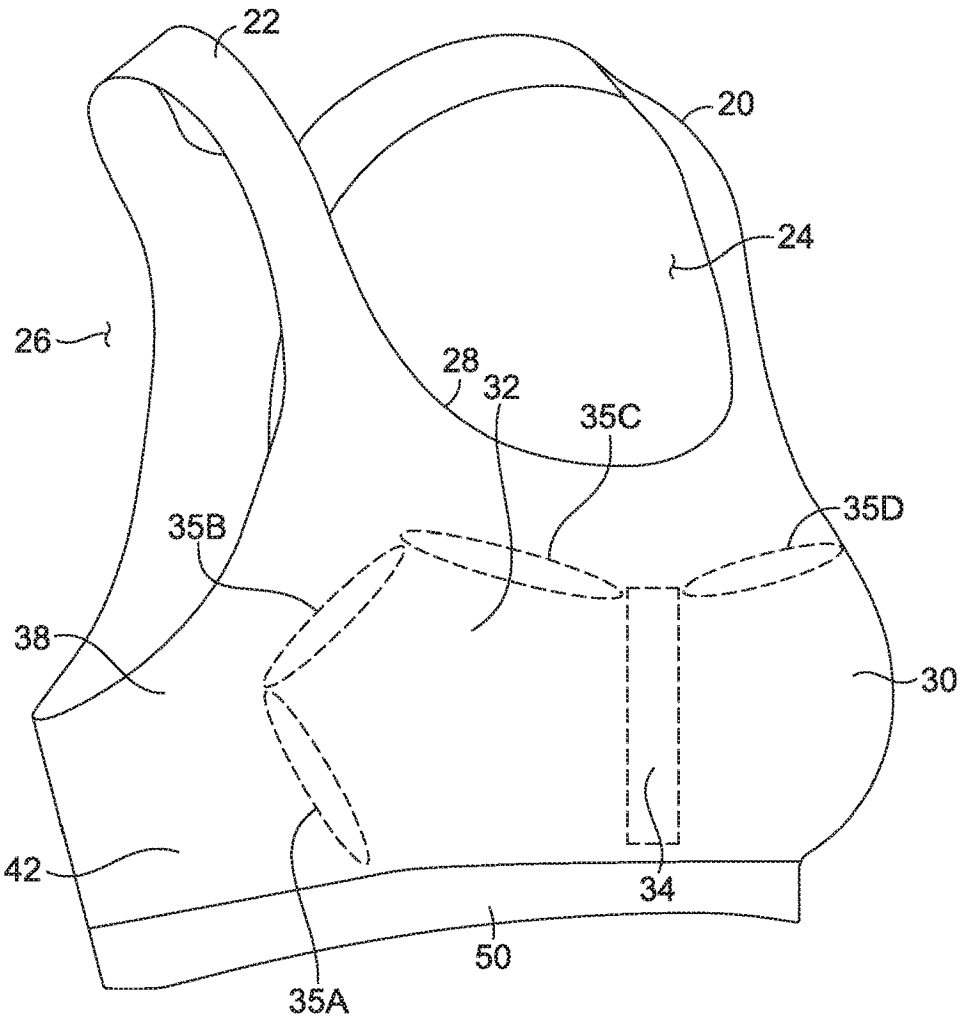
FIG. 2 depicts a front perspective view of the garment depicted in FIG. 1.

Referring initially to FIGS. 1-3, an exemplary upper-torso garment 10 is depicted, and in this description, "upper-torso garment" describes any garment configured to cover an upper-torso of a wearer. The illustrated upper-torso garment 10 is a bra, and the style of bra depicted is sometimes referred to as a sport bra, athletic bra, or other similar designation. In other aspects of this disclosure, an upper-torso garment may include a strapless bra, a camisole, a base-layer shirt, a singlet, a racing suit, and other styles or types of support garments used to support breast tissue.

When describing various aspects of the upper-torso garment 10, relative terms may be used to aid in understanding relative positions. For instance, the upper-torso garment 10 may be divided into a left side 12 and a right side 14. In addition, the upper-torso garment 10 may include a posterior portion 16 (FIG. 3), which typically covers at least part of a wearer's back when the upper-torso garment 10 is in an in-use state, and an anterior portion 18 (FIG. 3) that typically covers at least part of a wearer's chest in the in-use state.

Furthermore, the upper-torso garment 10 includes various parts that may also be referred to when describing aspects of the disclosure. For instance, the upper-torso garment 10 includes shoulder straps 20 and 22, as well as arm holes 24 and 26 and a neckline 28, which generally forms a perimeter around a neck-receiving aperture. In addition, the upper-torso garment 10 includes a breast-covering portion 30 on the left side 12 and a breast-covering portion 32 on the right side 14, and a center bridge 34 is positioned between the breast-covering portions 30 and 32. As used herein, the term "breast-covering portion" or "breast-contacting surface" refers to a region that is typically smaller than, and a region or zone of, a larger "chest-covering portion." And in example aspects, the term "breast-covering portion" or "breast-contacting surface" as used herein is meant to encompass any type of structure that is in contact with or positioned adjacent to the wearer's breasts when the upper-torso garment 10 is worn. With respect to the term "chest-covering portion," a chest-covering portion might include a left-side breast-covering region, a right-side breast-covering region, a center bridge, and upper-chest regions, among others. The upper-torso garment 10 also includes a series of encapsulation regions 35A, 35B, 35C, 35D, 35E, and 35F around at least a portion of a perimeter of the breast-covering portions 30 and 32.

Moreover, the upper-torso garment 10 includes a left underarm portion 36, a right underarm portion 38, a left wing 40, and a right wing 42. The posterior portion 16 includes a racerback-style rear panel having a main trunk 44 with rear straps 46 and 48. The trunk 44 and the rear straps 46 and 48 generally form a "T" shape or a "Y" shape, and the rear straps 46 and 48 connect with the shoulder straps 20 and 22. This configuration is illustrative only and other configurations for the posterior portion 16 are contemplated herein. A chest band 50 extends circumferentially beneath the breast-covering portions 30 and 32 and beneath the wings 40 and 42 and wraps entirely around to the posterior portion 16. The chest band 50 is illustrated without any clasp or other releasable connector, which might be included in an alternative aspect. These relative regions and parts are not necessarily intended to demarcate precise areas of the upper-torso garment 10, and they are provided for explanatory and illustrative purposes. In some instances, the upper-torso garment 10 may include structural elements, such as seams or transition zones, which provide logical divisions or demarcation.

The upper-torso garment 10 may include other parts, regions, and portions that are not necessarily denoted in FIGS. 1-3, such as a cradle region, an underwire, and the like. In addition, as indicated above, the bra-style, upper-torso garment 10 depicted in FIGS. 1-3 is merely illustrative of a type of upper-torso garment, and in other aspects of this disclosure, an upper-torso garment may have sleeves, an abdomen-covering portion, a lumbar-covering portion, integral shorts or pants (e.g., such as in a unitard with or without sleeves and with various leg lengths), and the like. Furthermore, in other aspects of the disclosure, an upper-torso garment may not include all of the parts and regions depicted in FIGS. 1-3. For example, an upper-torso garment might have different encapsulation regions (or no encapsulation regions), a different-sized center bridge (or no center bridge), a different posterior structure (such as crisscross, tank-style, and the like), no shoulder or rear straps, and the like.

In an aspect of this disclosure, the upper-torso garment 10 includes a knit textile region, and as used in this disclosure, "knit textile region" generally refers to at least a portion of the upper-torso garment 10 constructed of one or more yarn strands that are formed into knit stitches. More specifically, the knit stitches are interlooped to form a set of consecutively arranged knit courses and a set of consecutively arranged wales. As used in this disclosure, a "course" includes a horizontal row of knit stitches produced by adjacent needles, and a "wale" is a predominantly vertical column of intermeshed or interlooped knitted loops, generally produced by the same needle at successive (but not necessarily all) courses or knitting cycles. As used herein, the terms "horizontal" and "vertical" are relative to an upright fabric as knitted in which the heads of knitted loops face towards the top of the fabric, and the course knitted first is oriented at the bottom of the fabric. As used in this disclosure, a "knit stitch" may include a knitted loop stitch, which includes stitch legs (or a stitch base) that interloop in a first course and stitch head that interloops in an immediately subsequent or successive course. A knitted loop stitch is typically created when a knitting needle, which is retaining a first loop, receives a second loop, at which point the first loop is knocked over, or released, from the needle.

For instance, in FIG. 1, an exemplary knit textile region 52 is identified, and additional details of the knit textile region 52 are further depicted in a magnified view 54, which illustrates an exemplary knit structure 56. The knit structure 56 is a double-knit fabric having a front weft-knit layer 60 and a back weft-knit layer 62, as depicted by the partially exploded view 58. The front weft-knit layer 60 includes courses 61A-E of side-by-side consecutive stitches and wales 61F-H of interlooped stitches, and the back weft-knit layer 62 includes courses 62A-E of side-by-side consecutive stitches and wales 62F-H of interlooped stitches. Although not illustrated in FIG. 1, the front weft-knit layer 60 and the back weft-knit layer 62 may be coupled to one another by a binder yarn strand passing back and forth between tuck stitches in the front weft-knit layer 60 and in the back weft-knit layer 62.

The knit textile region 52 is identified in FIG. 1 for illustrative purposes to allow for the depiction and explanation of knit structures, and in other aspects of this disclosure, the upper-torso garment 10 includes one or more other knit textile regions that are larger than the knit textile region 52 and/or are positioned in other regions and parts of the upper-torso garment 10. For example, at least some of the anterior portion 18 of the upper-torso garment 10 may include one or more knit structures, including the chest band 50, breast-covering portions 30 and 32, center bridge 34, encapsulation regions 35A-F, underarm portions 36 and 38, wings 40 and 42, shoulder straps 20 and 22, and any combination thereof. These parts of the upper-torso garment 10 may be integrally knit as a continuous knit panel or may be separate knit panels that are coupled together to form the upper-torso garment 10.

The breast-covering portions 30 and 32 include various features that help to distinguish the breast-covering portions 30 and 32 from other zones, regions, or parts of the upper-torso garment 10. For example, the breast-covering portions 30 and 32 are generally positioned between the chest band 50 and the shoulder straps 20 and 22, or between the chest band 50 and the front neckline 28. In addition, the breast-covering portions 30 and 32 are generally on the anterior portion 18 of the upper-torso garment 10, between the underarm portions 36 and 38 and between the wings 40 and 42. Furthermore, as suggested by FIGS. 1-3, the breast-covering portions 30 and 32 may be separated by a center bridge 34 and may be bordered on one or more sides by encapsulation regions 35A-F. In some other aspects, the center bridge 34 may be omitted, such that the breast-covering portions 30 and 32 form a single breast-covering portion that spans the anterior portion 18 from the left wing 40 and underarm portion 36 to the right wing 42 and underarm portion 38. Likewise, the thickness of the encapsulation regions 35A-F may be reduced or increased, or the encapsulating regions may be omitted in other aspects of the disclosure.

As illustrated by the views of FIG. 2 and FIG. 3, the breast-covering portions 30 and 32 include a convex exterior surface 70, and as such include a concave interior surface that is not viewable from the perspectives shown in FIGS. 1-3. The breast-covering portions 30 and 32 may cover and possibly contact a breast region of the wearer when the upper-torso garment 10 is in an in-use state, such as when donned by a human or mannequin. Furthermore, the breast-covering portions 30 and 32 may function in combination with the other parts of the upper-torso garment 10 to provide support to breast tissue of a wearer, and the support provided may be compressive support, encapsulating support, or any combination thereof. The size and shape of the breast-covering portions 30 and 32 depicted in FIGS. 1-3 are illustrative of one aspect of the subject matter described herein, and in other aspects, the size and shape may be varied.

The support functionality of the upper-torso garment 10 may depend on a variety of different factors, such as the shape and dimensions (e.g., height, width, depth, etc.) of the breast-covering portions 30 and 32, as well as the yarn type and stitch structure. The breast-covering portions 30 and 32 having the convex exterior surface 70 are dome shaped and may be constructed in various manners. For example, in one aspect of the present disclosure, the dome-shaped breast-covering portions 30 and 32 each include a plurality of partial-length courses, which add material (i.e., knit stitches) to different locations throughout the breast-covering portions 30 and 32 to build up the knit textile region and create the dome shape.

Support functionality may be assessed in various manners, such as by measuring a modulus of elasticity of a knit panel, in which a smaller modulus generally translates to a less compressive garment, and a greater modulus generally translates to a more compressive garment. In other aspects, support functionality may be assessed by a qualitative interview of one or more test persons wearing the product while performing a selected activity. In additional aspects, support functionality may be assessed based on an amount of breast-tissue displacement, measured in an x, y, and/or z-axis, experienced by a tester donning an upper-torso garment while engaged in a selected activity or movement pattern. Support functionality may also be assessed based on angular movement (e.g., yaw, roll, and pitch) of the breast tissue in the x, y, and/or z-axis, experienced by a tester donning an upper-torso garment while engaged in a selected activity or movement pattern.

Described another way, the knit textile panels that construct the breast-covering portions 30 and 32 might include a plurality of knit courses that span the breast-covering portions 30 and 32 from the center bridge 34 to a lateral perimeter edge (e.g., to encapsulation regions 35A, 35B, 35E, and 35F). Furthermore, in accordance with an aspect of the present disclosure, the knit textile panels might also include a plurality of partial-length courses that are shorter than the plurality of knit courses and that are intermittently positioned among the plurality of knit courses. The partial-length courses add material in the form of knit stitches in order to construct the 3D-knit dome structures of breast-covering portions 30 and 32. In other words, if the portions of the upper-torso garment 10 that border the breast-covering portions 30 and 32 are arranged in an X-Y plane, then the partial-length courses build the breast-covering portions 30 and 32 in the Z direction.

In an aspect of the present disclosure, the partial-length courses are arranged to construct a 3D-knit dome structure having a shape and size that contributes to the support functionality of the upper-torso garment 10. For example, the partial-length courses may be unevenly distributed within the breast-covering portions 30 and 32. That is, the partial-length courses are unevenly distributed between the top half and the bottom half, between the right side and the left side, or any combination thereof.

Without aspects described in this disclosure, it might be challenging for some upper-torso garments to include a desired amount of a support functionality, such as if the breast-covering portions are too compressive in a manner that possibly creates discomfort or if the breast-covering portions are too relaxed in a manner that allows too much movement of breast tissue during activities. For example, if the breast-covering portions 30 and 32 are constructed of a yarn with relatively high elasticity, then absent aspects described in this disclosure, a size and/or shape of the dome structure in the breast-covering regions might not be effective at providing a desired amount of a support functionality—the upper-torso garment might be too compressive, might not be compressive enough, or might not provide an anatomical fit conducive to effective support functionality.

As used in this disclosure, elasticity or elastic properties describe the ability of a yarn to elongate or stretch, in response to a load, from a first length to a second length greater than the first length, along the central, longitudinal axis of a yarn, and then recover to a substantially non-stretched length relatively quickly when the load is removed. Examples of yarns that are often categorized as "elastic yarns" include spandex or elastane. In some instances, the term "elastic" describes a yarn that, under stress, elongates greater than 200%, and that recovers to a non-elongated length when the stress is removed.

Figure 4:
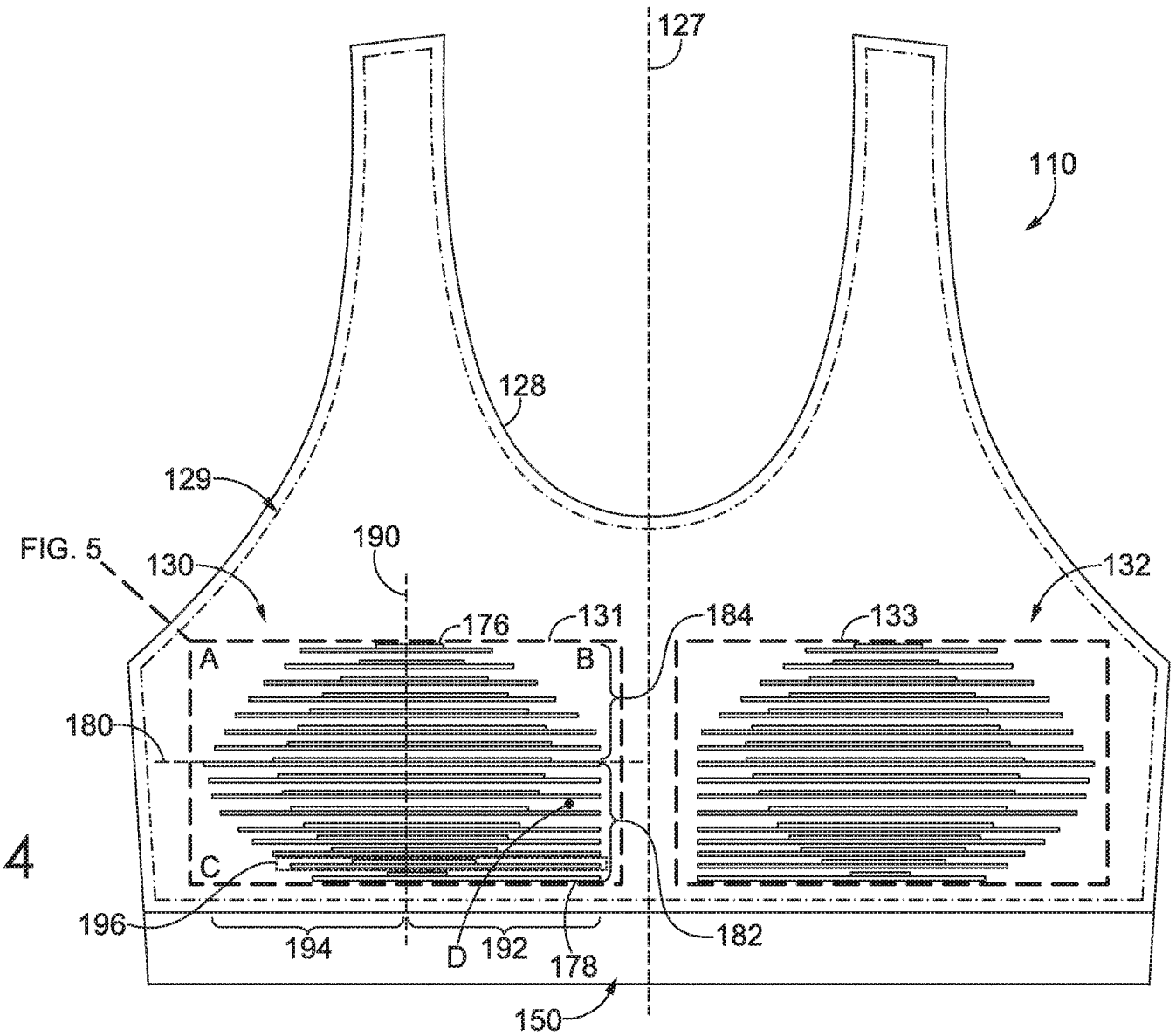
FIG. 4 depicts a schematic of a front portion of an upper-torso garment and illustrates an exemplary location of partial-length knit courses in accordance with an aspect of this disclosure.

Referring now to FIG. 4, a schematic diagram of a portion of an upper-torso garment 110 is depicted showing an arrangement of partial-length knit courses, and the arrangement depicted in FIG. 4 functions in combination with other aspects of the upper-torso garment 110 to provide an amount of a support functionality. In some aspects of this disclosure, the breast-covering regions of the upper-torso garment 110 include a knit panel including one or more elastic yarns that, in combination with the arrangement of partial-length knit courses, collectively function to provide an effective amount of support to a wearer's body. In a further aspect, the knit panel includes a double-knit panel with a binder yarn connecting the front and back knit layers, and the front layer, back layer, and binder each include at least one elastic yarn. In other aspects, the arrangement of partial-length knit courses in FIG. 4 is effective, in combination with non-elastic yarns (e.g., nylon or polyester) only (such that no elastic yarns are present), to provide an effective amount of support.

In FIG. 4, some details have been removed or simplified, and FIG. 4 illustrates how partial-length courses might be distributed and positioned in breast-covering portions in accordance with some aspects of this disclosure. The upper-torso garment 110 is depicted flat (as compared with the depictions in FIGS. 1-3), and it is understood that when an upper-torso garment 110 is constructed consistent with the schematic depiction of FIG. 4, the breast-covering portions will not be flat (as depicted in FIG. 4), and instead will include 3D-knit, dome-shaped structures similar to breast-covering portions 30 and 32 as illustrated in FIGS. 2 and 3.

In FIG. 4, the upper-torso garment 110 includes a front neckline 128, a chest band 150, and a chest-covering portion 129. For illustrative purposes, the chest-covering portion 129 is outlined by a dashed line, and a shape of the chest-covering portion 129 is at least partially dictated by a shape of the front neckline 128. In other aspects, the chest-covering portion 129 may have a different shape, such as when the front neckline 128 includes a different style (e.g., rounded, crew, square, u-shaped, halter, etc.).

In addition, FIG. 4 depicts a garment-midline reference plane 127 extending substantially perpendicular to the longitudinal axis of the chest band 150 and dividing the chest-covering portion 129 into a first side 130 comprising a first-side knit panel 131 and a second side 132 comprising a second-side knit panel 133. The first-side knit panel 131 might construct at least part of a first-side breast-covering portion (such as an embodiment of breast-covering portion 32 on the right side 14 in FIG. 1), and the second-side knit panel 133 might construct at least part of a second-side breast-covering portion (such as an embodiment of breast-covering portion 30 on the left side 12 in FIG. 1). The size and shape of the first-side knit panel 131 and the second-side knit panel 133 are merely illustrative of one aspect of the disclosure, and the first-side and second-side knit panels 131 and 133, respectively, may have other sizes and shapes in other aspects of the disclosure. The knit structure of the second-side knit panel 133 is a substantial mirror image of the first-side knit panel 131.

Figure 5:
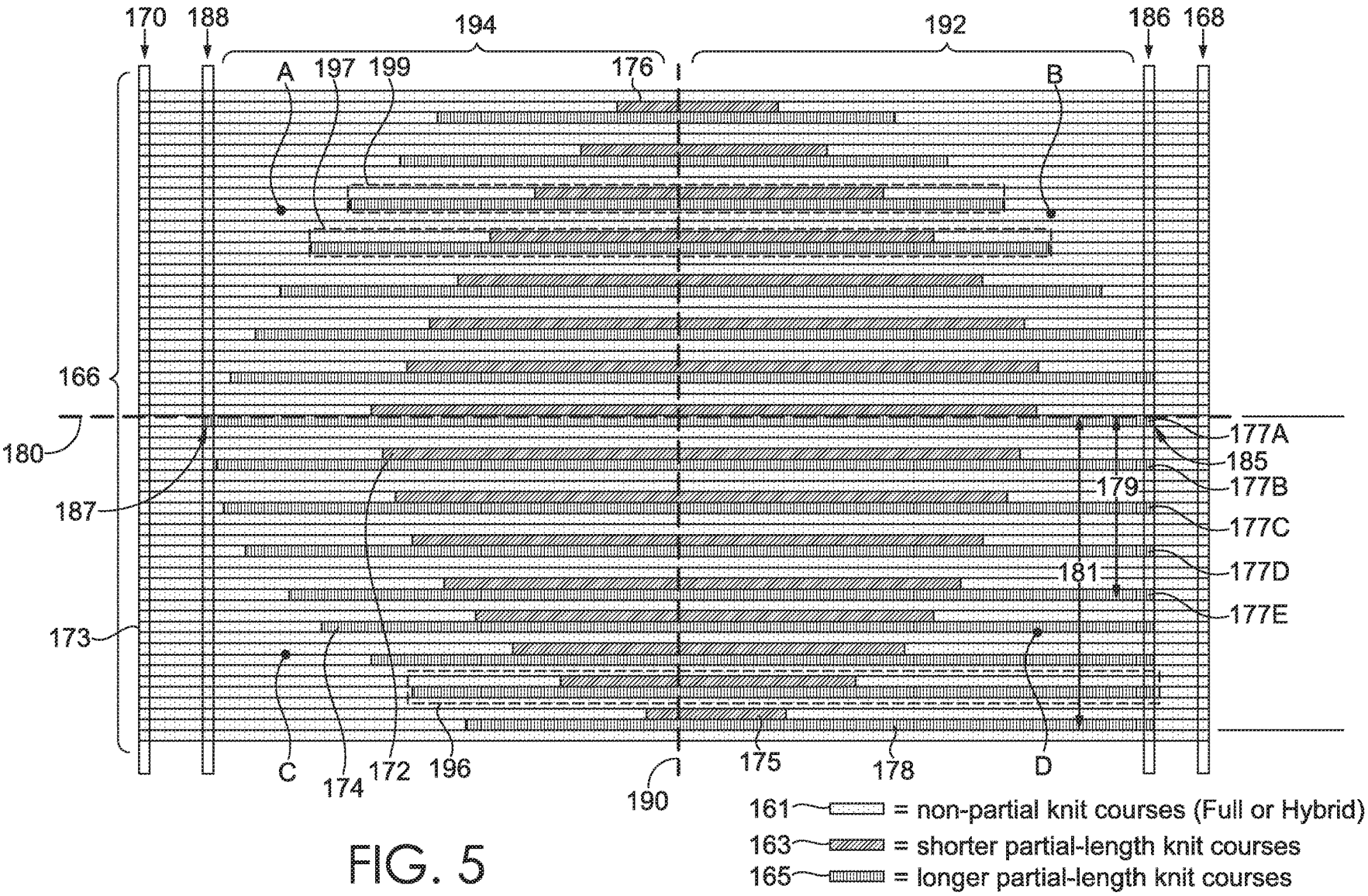
FIG. 5 depicts a magnified view of a knit-panel schematic of a portion of the upper-torso garment in FIG. 4 in accordance with an aspect of this disclosure.

A magnified view of the first-side knit panel 131 is depicted in FIG. 5. As previously described, the depiction of the first-side knit panel 131 is schematic, such that the depiction does not show actual knit stitches. Instead, the illustration includes hatch/pattern-coded rows to represent one or more knit courses. In accordance with an aspect of the present disclosure, a length of a knit course is characterized based on its relationship to a first wale and a second wale that are spaced apart from one another by a series of intermediate wales. For example, a first wale 168 is spaced apart from a second wale 170 by a series of consecutive intermediate wales. In the context of the first-side knit panel 131, the first wale 168 is a medial wale and the second wale 170 is a lateral wale. That is, the first wale 168 is "medial" because it is closer to the garment-midline reference plane 127 (relative to the second wale 170), and the second wale 170 is "lateral" because it is farther from the garment-midline reference plane 127 (relative to the first wale 168). In other aspects, elements of this innovation might be carried out in a knit panel that is agnostic or knit separately from an article of apparel and that merely includes a first wale and a second wale spaced apart from one another.

In accordance with an aspect of this disclosure, a "full-length course" (also referred to herein as a "full-length knit course) is a course of consecutive stitches that spans the entire distance of wales between the first wale 168 and the second wale 170. In accordance with another aspect, a "partial-length course" (also referred to herein as a partial-length knit course) is a course in which all of the consecutive stitches of the course are positioned between the first wale 168 and the second wale 170 (i.e., the stitches of a partial-length course are positioned only in the intermediate wales between the wales 168 and 170). In this disclosure, the full-length knit courses are described as "full-length" relative to the shorter and longer partial-length knit courses, and within the boundaries of the first-side knit panel 131. In other words, the full-length courses span the full distance between the medial wale represented by the first wale 168 and the lateral wale represented by the second wale 170, and in some aspects, the full-length courses might extend all the way from one side of a knit panel to the opposing side. In other aspects, a full-length course might extend to, or past, the wales 168 and 170 and then terminate before the edge of a knit panel and outside the boundaries of the first-side knit panel 131, in which case the course is still "full-length" relative to the shorter and longer partial-length knit courses 163 and 165, respectively. In contrast to the full-length courses, the partial-length courses are "partial-length" relative to the full-length courses, and each of the partial-length courses is positioned entirely between the wales 168 and 170 and fails to extend to either of the wales 168 and 170. In an additional aspect of this disclosure, a "hybrid course" describes a course of consecutive stitches having one end positioned outside or beyond the first wale 168 or the second wale 170 (i.e., medial of the first wale 168 or lateral of the second wale 170), and an opposing end that terminates among the intermediate wales and between the first wale 168 and the second wale 170. In some portions of this disclosure, the term "non-partial-length courses" is used as a generic descriptor of both hybrid courses and full-length courses. In accordance with aspects of this disclosure, a full-length course, a partial-length course, and a hybrid course includes a series of consecutive knitted loops. In addition, each of these types of courses may include held stitches, tuck stitches, floats, or any combination thereof interspersed thereamong.

Figure 6:
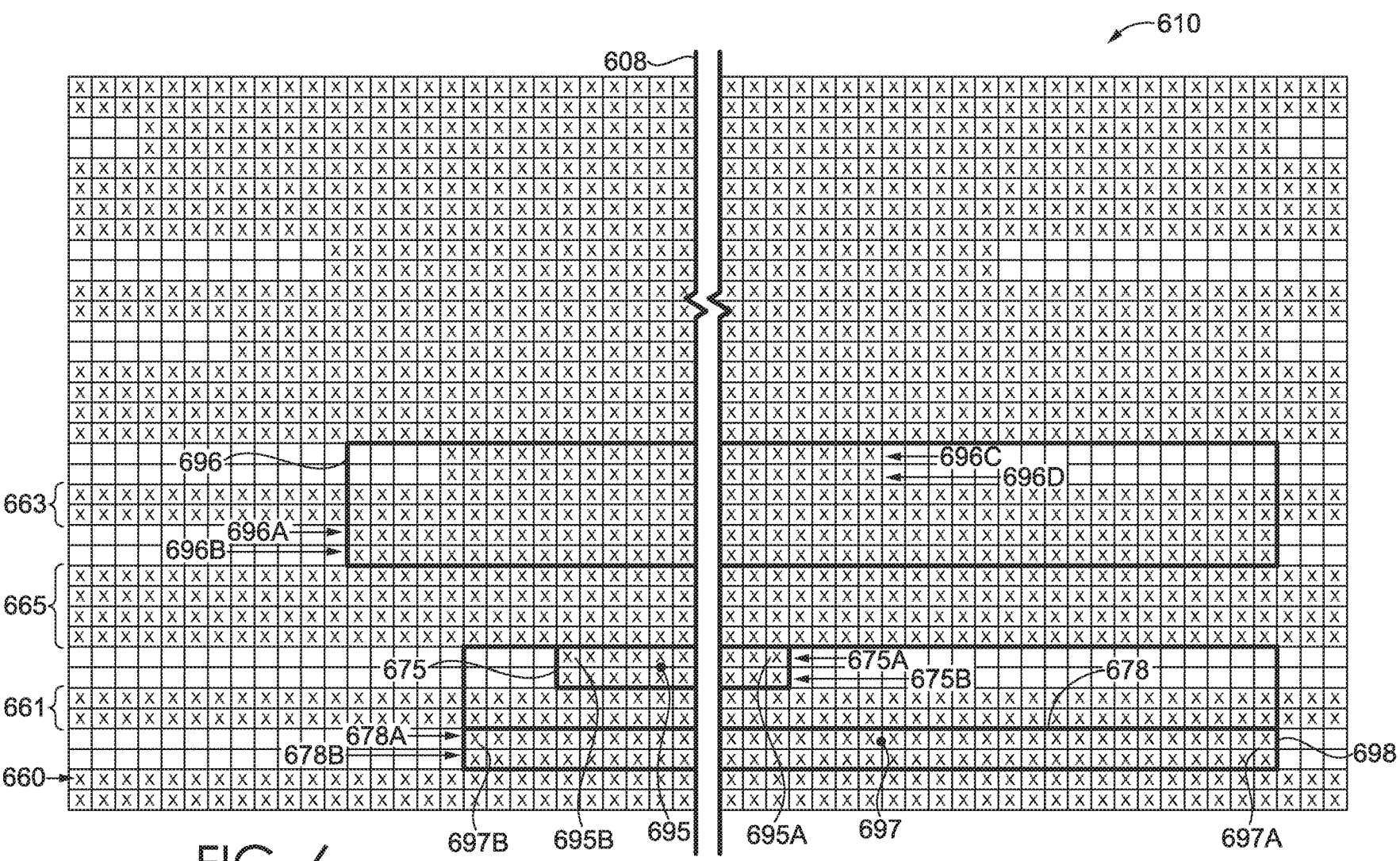
FIG. 6 depicts a knit diagram representing stitches that could be executed consistent with a portion of the knit-panel schematic of FIG. 5 in accordance with an aspect of this disclosure.
Figure 7:
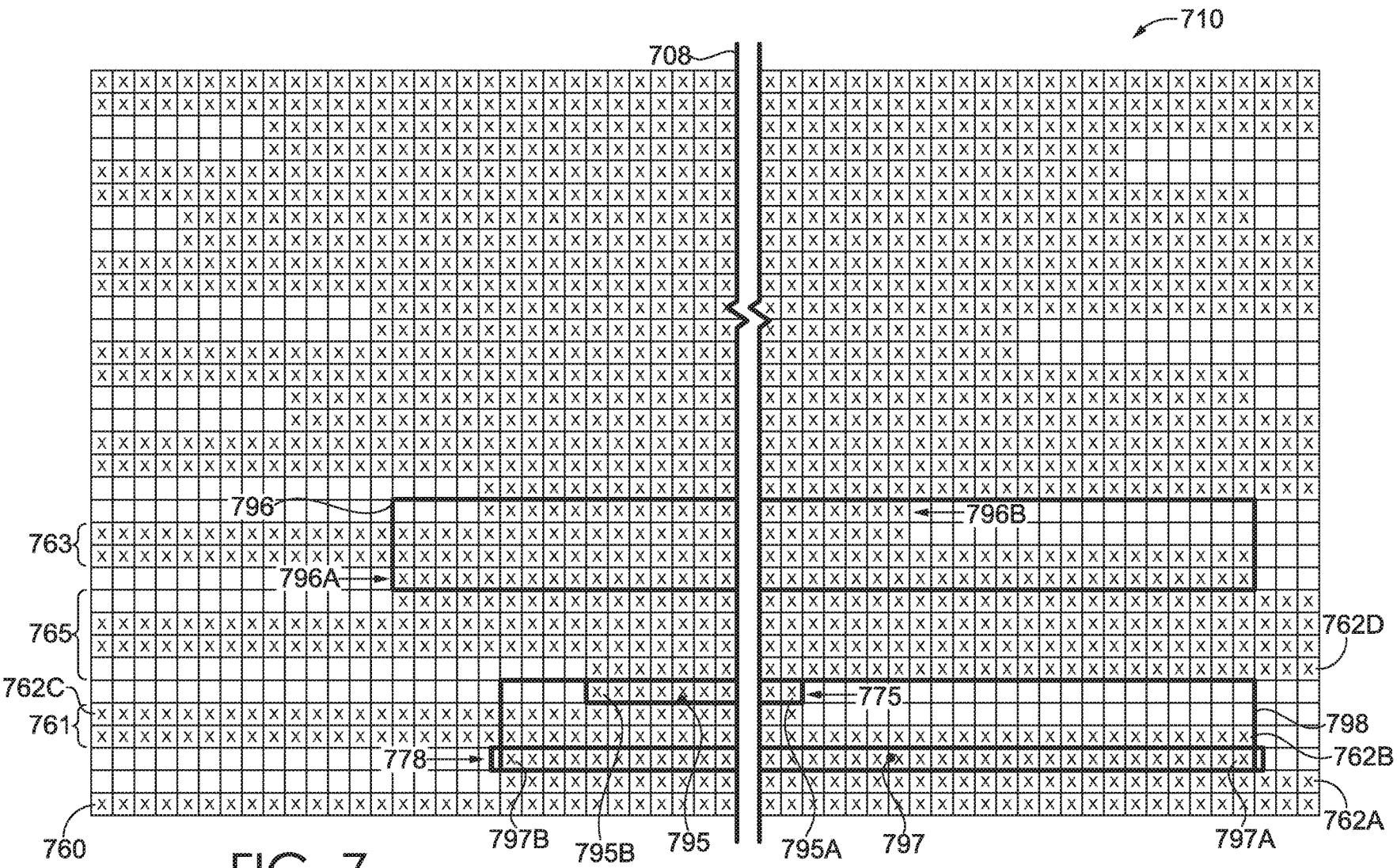
FIG. 7 depicts a knit diagram representing stitches that could be executed consistent with a portion of the knit-panel schematic of FIG. 5 in accordance with an aspect of this disclosure.

In the schematic depiction of FIG. 5, the stipple-filled rows 161 represent full-length interlooping knit courses, hybrid courses, or any combination thereof, and the legend in FIG. 5 identifies the stipple pattern as "non-partial-length courses." The diagonal-hatch 163 and vertical-hatch 165 rows represent shorter partial-length knit courses and longer partial-length courses (respectively) interspersed among the interlooping, non-partial-length knit courses. As such, the depictions in FIGS. 4 and 5 illustrate a distribution of partial-length courses relative to one another, even though these figures do not show individual stitches. The schematic of FIG. 5 might be carried out in various ways, and FIGS. 6 and 7 each depict a respective knit stitch diagram showing how some of the elements depicted in FIG. 5 might be implemented in a knit layer (e.g., front knit layer, back knit layer, or binder layer created from a binder yarn). FIGS. 6 and 7 are described in more detail in other portions of this disclosure.

The first-side knit panel 131 includes a series of consecutively arranged interlooping full-length and/or hybrid knit courses 166 extending substantially parallel to the chest band 150. Each full-length course in the series of courses 166 includes a quantity of stitches consecutively positioned from the first wale 168, which is closer to the garment-midline reference plane 127 on the first side (such as first side 130), to the second wale 170, which is farther from the garment-midline reference plane 127 on the first side. In addition, each hybrid knit course (if any) includes a quantity of consecutive stitches extending from at least the first or second wale 168 or 170, respectively, and terminating among the wales between the first or second wale 168 and 170, respectively. As previously indicated, the depiction in FIG. 5 is schematic in nature, and the width of the elongated rectangles denoting the wales 168 and 170 in FIG. 5 may not be to scale. In reality, the wales including a single column of interlooped stiches might be narrower or wider relative to the first-side knit panel 131.

The series of consecutively arranged interlooping knit courses 166 includes a plurality of partial-length knit courses (e.g., shorter partial-length knit course of row 172 and longer partial-length knit course of row 174) interspersed thereamong. Each partial-length knit course in the plurality of partial knit courses includes a fewer quantity of stitches than each full-length course in the series 166 of consecutively arranged interlooping knit courses. The rows representing partial-length knit courses in FIG. 5 are depicted as obscuring some portions of the rows representing non-partial-length knit courses. For example, the row 174 obscures a portion of the row 173. However, the abutting of the row 174 with the row 173 (in FIG. 5) does not necessarily translate to a termination of all stitches in the row 173 at the point where row 173 ends and row 174 starts. As will be explained with respect to FIGS. 6 and 7, in at least some implementations of the schematic in FIG. 5, the row 173 may include additional stitches that extend to the medial end of the row 174 or all the way to the first wale 168. In this sense, the schematic of FIG. 5 illustrates the arrangement of the partial-length knit courses and does not necessarily depict the stitch-by-stitch knit structure of the first-side knit panel 131. Examples of a stitch-by-stitch representation are provided by FIGS. 6 and 7, which will be described in more detail in another portion of this disclosure.

The plurality of partial-length knit courses includes a superior partial-length knit course 176 spaced a largest number of courses away from the chest band 150 relative to all other partial-length knit courses in the plurality of partial-length knit courses. In addition, the plurality of partial-length knit courses includes an inferior partial-length knit course 178 spaced a fewest number of courses apart from the chest band 150 relative to all other partial-length knit courses in the plurality of partial-length knit courses. As previously explained, reference numeral 178 may represent a plurality of courses. For example, referring briefly to FIG. 6, the reference box 678 identifies two longer partial-length knit courses 678A and 678B that could be represented by 178, and in that case, the longer partial-length knit course 678B would qualify as the inferior partial-length knit course. The same applies to reference numeral 176, which could schematically represent two or more courses. In other instances, the rows 176 and 178 represent a single partial-length course. A plurality of intermediate partial-length knit courses is arranged between the superior partial-length knit course 176 and the inferior partial-length knit course 178. Furthermore, a first dome reference midline 180 extends substantially parallel to the chest band 150 and is spaced an even number of courses between the superior partial-length knit course 176 and the inferior partial-length knit course 178. The first dome reference midline 180 divides an inferior dome portion 182 from a superior dome portion 184 as shown in FIG. 4.

Continuing with FIGS. 4 and 5, the plurality of partial-length knit courses 163 and 165 includes one or more medial-most knit stitches (e.g., the stitch represented by medial-most knit stitch 185 aligned with the medial wale 186) spaced a fewest number of wales from the first wale 168 or from the garment-midline reference plane 127 relative to any other knit stitches included among the plurality of partial-length knit courses. In addition, the plurality of partial-length knit courses 163 and 165 includes one or more lateral-most knit stitches (e.g., the stitch represented by lateral-most knit stitch 187 aligned with the wale 188) that are spaced a largest number of wales from the first wale 168 or the garment-midline reference plane 127 relative to any other knit stitches included among the plurality of partial-length knit courses 163 and 165. A second dome reference midline 190 extends perpendicular to the first dome reference midline 180 and is spaced an even number of wales between the one or more medial-most knit stitches 185 and the one or more lateral-most knit stitches 187. The second dome reference midline 190 divides a medial dome portion 192 from a lateral dome portion 194.

An intersection of the first and second dome reference midlines 180 and 190 creates a superior-lateral dome portion A, a superior-medial dome portion B, an inferior-lateral dome portion C, and an inferior-medial dome portion D. In accordance with an aspect of this disclosure, the inferior-medial dome portion D includes a larger concentration of knit stitches in partial-length courses than each of the superior-lateral dome portion A, the superior-medial dome portion B, and the inferior-lateral dome portion C. As such, the disproportionate distribution of partial-length knit courses forms an irregular-shaped dome (i.e., asymmetrical), and an illustrative topographic representation is depicted in FIG. 8.

Figure 8:
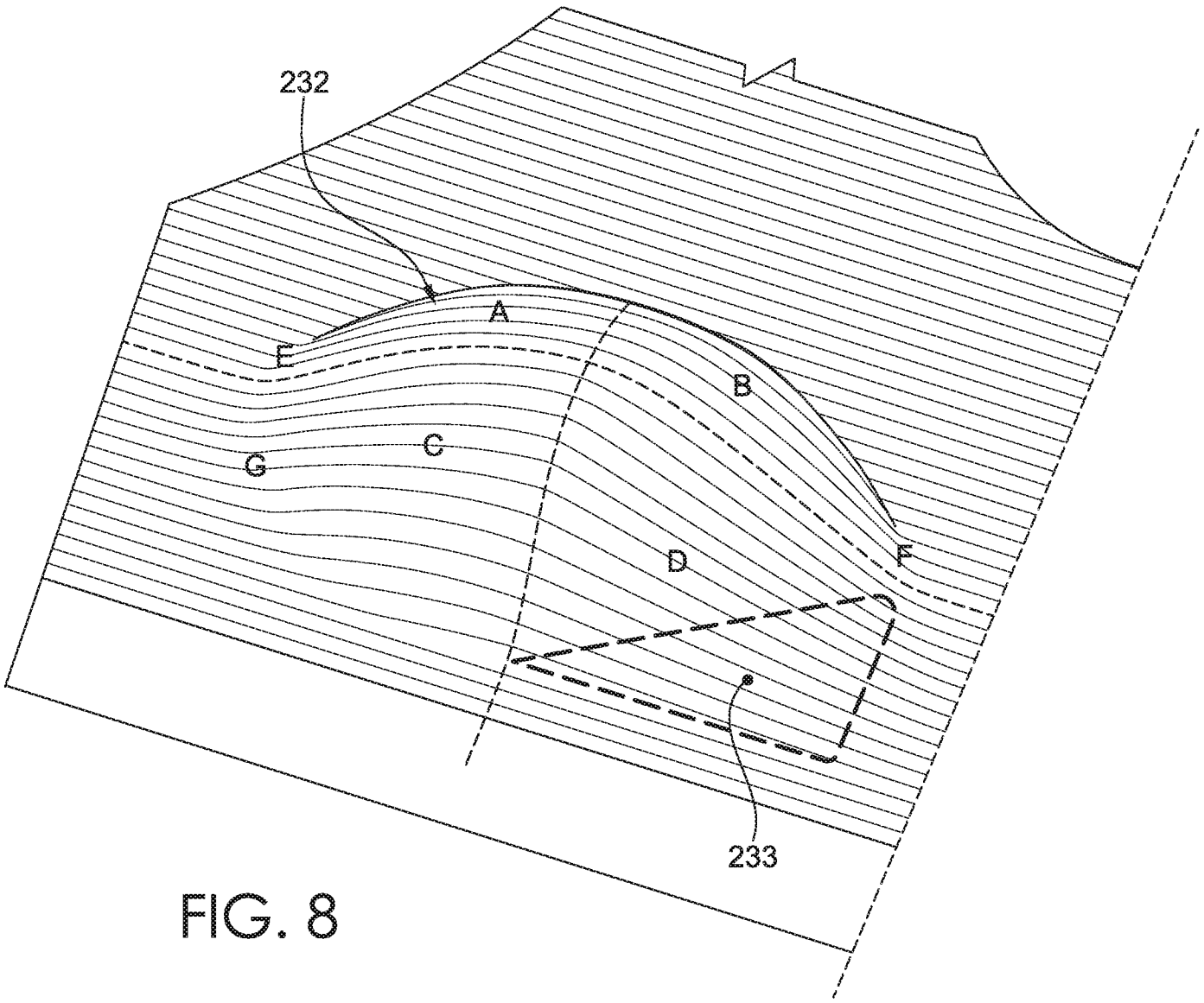
FIG. 8 depicts a topographical representation of a knit panel included in the upper-torso garment of FIG. 4 in accordance with an aspect of this disclosure.

FIG. 8 illustrates one possible irregular-dome-shaped knit wall forming an irregular-shaped dome 232 that might be located in a right-side, breast-covering portion when partial-length knit courses are arranged consistent with the schematic of FIGS. 4 and 5. A left-side, breast-covering region (not shown) might include a mirror image of the elements depicted in FIG. 8. The irregular-shaped dome 232 includes a superior-lateral region A, a superior-medial region B, an inferior-lateral region C, and an inferior-medial region D. As depicted in FIG. 5, all of the longer partial-length knit courses 165 in the inferior-medial region D each have medial-most stitches that are aligned with (i.e., in the same medial wale 186) the medial-most knit stitch 185. In contrast, the longer partial-length knit courses 165 in the other regions A, B, and C gradually taper in length as the region extends from the reference midline 180 towards the superior or inferior end of the dome. As such, the inferior-medial region D includes a larger distribution of knit stitches making up the partial-length courses, which creates additional volume or pocket 233 (see FIG. 8) that is absent from (or not as large in) the other regions A, B, and C.

FIG. 5 depicts one aspect in which, in region D, all of the longer, partial-length knit courses 165 are aligned with the medial-most knit stitch 185 (i.e., in the same medial wale 186). In other aspects, the inferior-medial region D still includes a larger proportion of stitches included in partial-length courses (i.e., as compared with regions A, B, and C), and fewer than all of the longer, partial-length knit courses 165 in region D are aligned with the medial-most knit stitch 185. For example, the inferior-medial region D may include a subset of partial-length knit courses (e.g., 177A-177E), each of which includes a respective medial-most knit stitch. In FIG. 5, the subset includes five courses, and in other aspects, the subset may include between two and fifteen courses. The subset may include more courses, and the number of courses within the subset may depend, at least in part, on how big the upper-torso garment is, and in turn how many courses are constructed into the first-side knit panel 131. In one aspect, each of the respective medial-most knit stitches (of each course in the subset) may be included among a set of ten consecutive wales, one of which is the medial wale 186. (For purposes of this portion of the disclosure, courses 177A-177E are identified as being in the subset, and other courses might also be in the subset, such as course 178.) In a further aspect, each of the respective medial-most knit stitches may be included among a set of five consecutive wales, one of which is the medial wale 186. Further still, in another aspect, each of the respective medial-most knit stitches may be included among a set of two consecutive wales, one of which is the medial wale 186. For example, each medial-most knit stitch for each course within the subset may align with a different wale. In another example, the medial-most knit stitch of at least two courses within the subset are aligned with different wales. Positioning a plurality of the respective medial-most knit stitches among a relatively small number of consecutive wales contributes to, among other things, the shape of the knit dome 232 and the resulting fit and support functionality. For example, by aligning the respective medial-most knit stitches among a relatively small set of consecutive wales (i.e., compared to the medial and lateral course-terminal stitches in the other regions A, B, and C), a straighter, less tapered or less curved dome edge is formed in region D where the inferior-medial portion abuts the more central portion of the upper-torso garment.

In a further aspect, the span 179 of the subset of partial-length knit courses (e.g., 177A-177E), each of which has a respective medial-most knit stitch among a relatively small set of consecutive wales (e.g., two wales), also affect the shape of the irregular-shaped dome 232. The span 179 is the distance (e.g., number of courses) extending from the superior-most partial-length knit course 177A in the subset to the inferior-most partial-length knit course 177E in the subset. As such, in one aspect, the span 179 is at least fifty percent of the distance 181 (e.g., number of courses) between the reference midline 180 and the inferior-most partial-length knit course 178. The span 179 may be greater than fifty percent of distance 181 as depicted in FIG. 5. In one aspect, the span 179 may be greater than ninety percent of distance 181. Among other things, the span 179 may factor into the length of a relatively straight, non-tapered or non-curved dome edge where the respective medial-most knit stitches of the subset of partial-length knit courses is within a relative small set of consecutive wales (e.g., one wale or two whales).

The irregular-shaped dome 232, including the additional pocket 233, contributes to the support functionality of an upper-torso garment in various ways. For example, the irregular-shaped dome 232 may provide a desired anatomical fit. In addition, the irregular-shaped dome 232 functions as a whole to provide strategically positioned encapsulation around the periphery of the regions A, B, C, and D. For example, the transitions at regions E, F, and G from the irregular-shaped dome 232 to a flatter knit panel might provide at least some encapsulation in those regions that biases or presses breast tissue towards the additional volume created in the pocket 233. Furthermore, the bias provided om regions E and F, positioned superior to a horizontal midline, might help to reduce or attenuate vertical or up-and-down shifting of breast tissue during activity (e.g., jogging, jumping, etc.), and region G, positioned inferior to a horizontal midline, might provide encapsulation in a region (e.g., an inferior-lateral region) that often includes a larger distribution of breast tissue.

The schematic depictions of FIGS. 4 and 5 illustrate that, in one aspect of the disclosure, the longer partial-length knit courses 165 are dispersed among shorter partial-length knit courses 163. For example, in FIGS. 4 and 5, one or more longer partial-length knit courses 165 are followed by one or more shorter partial-length knit courses 163, and in FIGS. 4 and 5, the alternating sequence continues from the superior partial-length knit course 176 to the inferior partial-length knit course 178. In other aspects, the arrangement of partial-length courses includes the longer partial-length knit courses 165 that form the additional pocket 233 depicted in FIG. 8, and the shorter partial-length knit courses 163 might be omitted.

In another aspect of the disclosure, the plurality of partial-length knit courses includes sub-groups or sub-sets (referred to herein as groupings) of partial-length knit courses. For example, in FIGS. 4 and 5, the box 196 encloses one of the partial-length-course groupings. Each partial-length-course grouping includes one or more longer partial-length knit courses 165 and one or more shorter partial-length knit courses 163, and the one or more longer partial-length knit courses 165 are spaced apart from the one or more shorter partial-length knit courses 163 by a first quantity of non-partial-length knit courses 161 (i.e., full-length course, hybrid-courses, or any combination thereof). In some aspects, the first quantity of non-partial length knit courses 161 is zero. In addition, each partial-length-course grouping is spaced apart from a consecutively arranged partial-length-course grouping by a second quantity of non-partial-length knit courses 161 (i.e., full-length courses, hybrid-courses, or any combination thereof), the second quantity being larger than the first quantity. In accordance with an aspect of this disclosure, the first-side knit panel 131 is constructed such that the first quantity and second quantity form a ratio in a range of about 1:2 to about 1:6 as illustrated in FIGS. 6 and 7. For example, the first quantity may include a single course and the second quantity may include two or more courses. In another example, the first quantity may include two courses, and the second quantity may include three, four, or more than four courses. These are merely examples of some aspects of the disclosure, and in other aspects the ratio might be outside the range of 1:2 and 1:6.

An example of how the partial-length courses, full-length courses, and hybrid courses might be arranged is depicted in FIGS. 6 and 7, which include stitch diagrams of a portion of a knit panel. In an aspect of this disclosure, a portion of the first-side knit panel 131 (including portions of FIGS. 4 and 5) is constructed consistent with the stitch diagram in FIG. 6. In another aspect of this disclosure, a portion of the first-side knit panel 131 is constructed consistent with the stitch diagram in FIG. 7. For example, if the first-side knit panel 131 is a single knit textile, then the single layer of knit stitches might be constructed consistent with FIG. 6 or consistent with FIG. 7. In another instance, if the first-side knit panel 131 is a double-knit textile, then the front knit layer, the back knit layer, or both the front knit layer and the back knit layer might be constructed consistent with FIG. 6 or consistent with FIG. 7. Furthermore, if the double-knit textile includes a binder, then the binder might be constructed in a manner consistent with FIG. 6 or consistent with FIG. 7.

In the knit-stitch diagram 610 of FIG. 6, each box with an "X" represents a knit stitch. The stitch diagram of FIG. 6 depicts an arrangement of non-partial-length knit courses (e.g., 660), longer partial-length knit courses (e.g., 678A and 678B), and shorter partial-length knit courses (e.g., 675A and 675B) in accordance with an aspect of this disclosure. A break line 608 indicates an indeterminate length or number of stitches, such that the courses might include additional stitches in other embodiments. In alternative embodiments, one or more other types of knit structures might be interspersed among the knitted loops, such as held stitches, floats, tucks, or any combination thereof.

The diagram 610 includes a reference box 675 designating shorter partial-length knit courses 675A and 675B and a reference box 678 designating longer partial-length knit courses 678A and 678B. In one aspect, the reference box 675 correlates with each shorter partial-length knit courses 172 in FIG. 5, and the reference box 678 correlates with each longer partial-length knit courses 174 in FIG. 5. Furthermore, in accordance with another aspect, the longer partial-length knit courses 678A and 678B and the shorter partial-length knit courses 675A and 675B collectively form a partial-length-course grouping bounded by the reference box representing the grouping 698.

FIG. 6 depicts another partial-length-course grouping that is bounded by a reference box representing a grouping 696 and that includes the longer partial-length knit courses 696A and 696B and the shorter partial-length knit courses 696C and 696D. The partial-length-course grouping 696 is an example of a stitch arrangement that might construct the grouping 196 in FIGS. 4 and 5. As explained, in accordance with an aspect of the disclosure, the one or more longer partial-length knit courses 678A-B in grouping 698 are spaced apart from the one or more shorter partial-length knit courses 675A-B in grouping 698 by a first quantity of non-partial-length knit courses, and bracket 661 indicates that the first quantity may be two courses. In a similar manner, bracket 663 indicates that two courses separate the longer partial-length knit courses 696A-B in grouping 696 from the shorter partial-length knit courses 696C-D in grouping 696, such that the first quantity identified by bracket 663 is two. In addition, each partial-length-course grouping is spaced apart from a consecutively arranged partial-length-course grouping by a second quantity of non-partial-length knit courses, the second quantity being larger than the first quantity. For instance, the bracket 665 identifies four courses that separate the grouping 696 from the grouping 698.

In the knit-stitch diagram 710 of FIG. 7, each box with an "X" represents a knit stitch. The stitch diagram of FIG. 7 depicts an arrangement of non-partial-length knit courses, which includes both full-length courses (e.g., 760) and hybrid courses (e.g., 762A, 762B, 762C, and 762D). A break line 708 indicates an indeterminate length or number of stitches, such that the courses might include additional stitches in other embodiments. In alternative embodiments, one or more other types of knit structures might be interspersed among the knitted loops, such as held stitches, floats, tucks, or any combination thereof.

In addition, FIG. 7 depicts longer partial-length knit courses 778 and shorter partial-length knit courses 775, in accordance with an aspect of this disclosure. In one aspect, the shorter partial-length knit course 775 correlates with one or more shorter partial-length knit courses 175 in FIG. 5, and the longer partial-length knit course 778 correlates with one or more longer partial-length knit courses 178 in FIG. 5. Furthermore, in accordance with another aspect, the longer partial-length knit course 778 and the shorter partial-length knit course 775 collectively form a partial-length-course grouping 798 bounded by the reference box.

FIG. 7 depicts another partial-length-course grouping 796 that is bounded by a reference box and that includes the longer partial-length knit course 796A and the shorter partial-length knit course 796B. Partial-length-course grouping 798 or partial-length-course grouping 796 may be an example of a stitch arrangement that might construct the grouping 196 in FIGS. 4 and 5. As explained, in accordance with an aspect of the disclosure, the one or more longer partial-length knit courses 778 are spaced apart from the one or more shorter partial-length knit courses 775 by a first quantity of non-partial-length knit courses, and bracket 761 indicates that the first quantity might be two courses (i.e., bracket 761 identifies two hybrid courses that are "non-partial-length"). In a similar manner, bracket 763 indicates that two courses separate the longer partial-length knit course 796A from the shorter partial-length knit course 796B, such that the first quantity identified by bracket 763 is two. In addition, each partial-length-course grouping is spaced apart from a consecutively arranged partial-length-course grouping by a second quantity of non-partial-length knit courses (full-length course, hybrid-courses, or any combination thereof), the second quantity being larger than the first quantity. For instance, the bracket 765 identifies four courses that separate the grouping 796 from the grouping 798.

In an aspect of the present disclosure, the knit-stitch diagram 710 designates a series of knit stitches in which a common yarn strand extends throughout sequential and consecutive courses. For example, a continuous yarn strand may extend throughout the full-length course 760 and then transition to the hybrid course 762A, then to the longer partial-length knit course 778, then to the hybrid course 762B, then to the hybrid course 762C, then to the shorter partial-length knit course 775, then to the hybrid course 762D, and so on. In this manner, the common yarn strand continuously extends throughout the knit panel. In one aspect, this knit structure is conducive to knitting on an automated, flat-bed knitting machine, such as a v-bed machine with a front and back set of needles and a carriage that reciprocates back and forth.

In another aspect of the present disclosure, at least some partial-length-course groupings in the superior portion of the dome shape are spaced apart by a larger number of courses than at least some partial-length-course groupings in the inferior portion of the dome shape. For example, FIG. 5 includes boxes representing groupings 197 and 199 that each identifies a respective partial-length-course grouping. Based on the schematic of FIG. 5, as well as the application of the prescription set forth in the knit diagram of FIG. 6 or FIG. 7, the groupings 197 and 199 might be spaced apart by five, six, seven, or eight non-partial-length knit courses. In some instances, this variance between the superior dome portion 184 and the inferior dome portion 182 (as identified in FIG. 4) in which a larger number of courses space apart consecutive partial-length-course groupings in the superior dome portion 184 contributes to the superior dome portion 184 having less dimensionality and a smaller volume than the inferior dome portion 182. In other instances, this variance might contribute to the superior dome portion 184 extending more gradually into the Z-direction of the first-side knit panel 131, relative to the inferior dome portion 182. Among other things, this varied distribution may contribute to a better anatomical fit based on breast-tissue distribution in which a breast region may include more tissue in an inferior portion (farther from a person's head) than in a superior portion (closer to a person's head).

In a further aspect of this disclosure, smaller spacing between intra-group courses (e.g., two courses between 675 and 678 or two courses between 775 and 778) and larger spacing between separate groupings (e.g., four courses between groupings 696 and 698 and four courses between groupings 796 and 798) contributes to a support functionality of the upper-torso garment. For example, the amount of spacing (e.g., number of courses) might play a factor in the quantity of partial-length rows that are collectively included in the first-side knit panel 131. In other words, smaller spacing may yield more dome volume as a result of additional partial-length knit courses being included within the first-side knit panel 131, and larger spacing may yield smaller dome volume as a result of fewer partial-length knit courses. In addition, the spacing strategy might play a factor in the amount of build-up produced in the Z-direction, as well as the depth or amount of curvature created in the breast-covering region. A spacing scheme with more densely arranged partial-length knit courses may create too much curvature and result in an upper-torso garment that fits too loosely and does not provide sufficient support. On the other hand, a spacing scheme providing for fewer partial-length knit courses might not provide enough dimensionality and result in a garment that is too compressive and is uncomfortable. In accordance with an aspect of this disclosure, the spacing scheme described herein, in which the first quantity (e.g., two courses) is smaller than the second quantity (e.g., four courses, six courses, or eight courses) and in which the pattern repeats, contributes to an effective amount of support for a wearer.

With continued reference to FIGS. 6 and 7, aspects of the present disclosure might be described or characterized in other ways. For example, each partial-length-course grouping (e.g., 696, 698, 796, and 798) includes a long-to-short ratio of a number of stitches in each longer partial-length knit courses to a number of stitches in each shorter partial-length knit courses. As explained in other parts of this disclosure, the inferior-medial region (e.g., inferior-medial dome portion D) includes a disproportionately greater number of partial-length course stitches, and this arrangement is partially on account of the inferior dome portion having a greater average long-to-short ratio than an average long-to-short ratio in the superior dome portion.

In another aspect of this disclosure, in each partial-length-course grouping (e.g., 698 or 798) at least one longer partial-length knit course includes a first course midpoint (e.g., 697 or 797) spaced an even distance between a medial-most stitch (e.g., 697A or 797A) and a lateral-most stitch (e.g., 697B or 797B) of the at least one longer partial-length knit course. In addition, at least one shorter partial-length knit course (e.g., 675 or 775) includes a second course midpoint (e.g., 695 or 795) spaced an even distance between a medial-most stitch (e.g., 695A or 795) and a lateral-most stitch (e.g., 695B or 795A) of the at least one shorter partial-length knit course. In accordance with an aspect of the present disclosure, in the inferior dome portion (e.g., combination of inferior-lateral dome portion C and inferior-medial dome portion D), a plurality of partial-length-course groupings include the first course midpoint of the longer partial-length knit course (e.g., 697 or 797) being offset towards the garment-midline reference plane 127 relative to the second course midpoint of the shorter partial-length knit course (e.g., 695 or 795). This offset (in a medial direction) contributes to the formation of the additional volume pocket 233 on the medial side, as compared with the lateral side of the inferior dome portion.

As described in other portions of this disclosure, the knit structure of the first-side knit panel 131 may contribute to the support functionality of the upper-torso garment 110, and in one aspect of this disclosure, the first-side knit panel 131 includes a double-knit panel having a front knit layer and a back knit layer connected by a binder yarn. The upper-torso garment 110, including the first-side knit panel 131, might be constructed using various methods of manufacture. For example, in one aspect, the upper-torso garment 110 may be constructed on a v-bed, computer-controlled knitting machine. The entire upper-torso garment 110 may be knit as a single integrated piece, which is then coupled together at particular locations to create a left side, right side, anterior portion, and posterior portion. In addition, certain parts of the upper-torso garment 110 may be knit separately from one another and then coupled to form the upper-torso garment 110. For instance, in one aspect, the anterior portion with straps is constructed separately from the posterior portion, and the two pieces are then coupled to form the upper-torso garment 110. These manufacturing aspects are merely exemplary, and various other techniques may also be utilized.

Other portions of this disclosure describe how the arrangement of partial-length courses may contribute to the support functionality of an upper-torso garment. Various other factors may also play a role, such as the stitch length, stitch density, yarn tension, yarn size, yarn type, and the like.

Having described various aspects illustrated in FIGS. 1-8, as well as alternative aspects, some additional aspects will now be described that draw on one or more of the illustrated, or alternative, aspects. As such, one further aspect of the disclosure is directed to an upper-torso garment (e.g., 110) having a dome-shaped knit breast-contacting surface (e.g., dome 232) comprised of a plurality of partial-length knit courses (e.g., 163 and 165). The plurality of partial-length knit courses include a plurality of knit stitches having one or more medial-most knit stitches (e.g., 185) arranged in a medial wale (e.g., 186) and one or more lateral-most knit stitches (e.g., 187) arranged in a lateral wale (e.g., 188). In addition, the plurality of partial-length knit courses includes a superior-most course (e.g., 176) and an inferior-most course (e.g., 178). The garment further includes a first dome reference midline (e.g., 190) extending substantially parallel to the medial wale or the lateral wale and spaced evenly between the medial wale and the lateral wale. The garment further includes a second dome reference midline (e.g., 180) extending substantially perpendicular to the first dome reference midline and spaced evenly between the superior-most course and the inferior-most course. A largest quantity of knit stitches from the plurality of knit stitches is positioned in an inferior-medial quadrant (e.g., inferior-medial portion D) designated by an intersection of the first and second dome reference midlines.

Another aspect of the disclosure is directed to an upper-torso garment (e.g., 110) having a knit dome structure (e.g., dome 232) comprising a plurality of partial-length knit courses (e.g., 163 and 165), which include a plurality of knit stitches. The knit dome structure includes a superior-lateral quadrant (e.g., superior-lateral portion A), a superior-medial quadrant (e.g., superior-medial portion B), an inferior-lateral quadrant (e.g., inferior-lateral portion C), and an inferior-medial quadrant (e.g., inferior-lateral portion D). The inferior-medial quadrant includes a larger quantity of knit stitches from the plurality of knit stitches, relative to the superior-lateral quadrant, relative to the superior-medial quadrant, and relative to the inferior-lateral quadrant.

In an additional aspect, the present disclosure includes an upper-torso garment (e.g., 110) having a dome-shaped knit breast-contacting surface (e.g., dome 232) comprised of a plurality of partial-length knit courses (e.g., 163 and 165). The plurality of partial-length knit courses includes one or more medial-most knit stitches (e.g., 185) arranged in a medial wale (e.g., 186) and one or more lateral-most knit stitches (e.g., 187) arranged in a lateral wale (e.g., 188). In addition, the plurality of partial-length knit courses includes a superior-most course (e.g., 176) and an inferior-most course (e.g., 178). The garment further includes a first dome reference midline (e.g., 190) extending substantially parallel to the medial wale or the lateral wale and spaced evenly between the medial wale and the lateral wale and a second dome reference midline (e.g., 180) extending substantially perpendicular to the first dome reference midline and spaced evenly between the superior-most course and the inferior-most course. The second dome reference midline designates a superior dome portion (e.g., 184) and an inferior dome portion (e.g., 182). One or more partial-length knit courses (e.g., 175A, 175B, 175C, 175D, 175E, 178, or any combination thereof) in the inferior dome portion include a greater number of knit stitches on a medial side of the first dome reference midline than on a lateral side of the first dome reference midline.

A further aspect of the present disclosure is directed to an upper-torso garment having a front neckline (e.g., 128), a chest band (e.g., 150), and a chest-covering portion (e.g., 129) located between the front neckline and the chest band. A garment-midline reference plane (e.g., 127) extends substantially perpendicular to the chest band and divides the chest-covering portion into a first side comprising a first-side knit panel (e.g., 131) and a second side comprising a second-side knit panel (e.g., 133) that is a substantial mirror image of the first-side knit panel. The first-side knit panel includes a series of consecutively arranged interlooping courses (e.g., 166 including full-length courses, hybrid courses, or any combination thereof) extending substantially parallel to the chest band. Each course has a quantity of stitches consecutively positioned between a medial wale (e.g., first wale 168), which is closer to the garment-midline reference plane on the first side, and a lateral wale (e.g., second wale 170), which is farther from the garment-midline reference plane on the first side. In addition, the quantity of stitches of each course extends beyond the medial wale, the lateral wale, or both the medial wale and the lateral wale. For example, the quantity of stitches of a full-length course extends beyond both the medial and lateral wale, and the quantity of stitches of a hybrid course extends beyond one of the medial wale and the lateral wale. The series of consecutively arranged interlooping knit courses includes a plurality of partial-length knit courses interspersed thereamong forming an irregular-dome-shaped knit wall (e.g., dome 232) in the first-side knit panel. Each partial-length knit course in the plurality of partial-length knit courses is positioned between the medial wale and the lateral wale. The plurality of partial-length knit courses includes a superior partial-length knit course (e.g., 176) spaced a largest number of courses away from the chest band relative to all other partial-length knit courses in the plurality of partial-length knit courses. In addition, the plurality of partial-length knit courses includes an inferior partial-length knit course (e.g., 178) spaced a fewest number of courses apart from the chest band relative to all other partial-length knit courses in the plurality of partial-length knit courses. A plurality of intermediate partial-length knit courses is arranged between the superior partial-length knit course and the inferior partial-length knit course. In addition, a first dome reference midline (e.g., 180) extends substantially parallel to the chest band and is spaced an even number of courses between the superior partial-length knit course and the inferior partial-length knit course. The first dome reference midline divides an inferior dome portion (e.g., 182) from a superior dome portion (e.g., 184). The plurality of partial-length knit courses includes one or more medial-most knit stitches (e.g., 185) spaced a fewest number of wales from the garment-midline reference plane relative to any other knit stitches included among the plurality of partial-length knit courses. In addition, the plurality of partial-length knit courses includes one or more lateral-most knit stitches (e.g., 187) that are spaced a largest number of wales from the garment-midline reference plane relative to any other knit stitches included among the plurality of partial-length knit courses. A second dome reference midline (e.g., 190) extends perpendicular to the first dome reference midline and is spaced an even number of wales between the one or more medial-most knit stitches and the one or more lateral-most knit stitches. The second dome reference midline divides a medial dome portion from a lateral dome portion. An intersection of the first and second dome reference midlines creates a superior-lateral dome portion (e.g., A), a superior-medial dome portion (e.g., B), an inferior-lateral dome portion (e.g., C), and an inferior-medial dome portion (e.g., D). The inferior-medial dome portion includes a larger concentration of knit stitches forming a portion of the plurality of partial-length knit courses than the superior-lateral dome portion, the superior-medial dome portion, and the inferior-lateral dome portion.

Another aspect of the present disclosure includes an upper-torso garment having a front neckline (e.g., 128), a chest band (e.g., 150), and a chest-covering portion (e.g., 129) located between the front neckline and the chest band. A garment-midline reference plane (e.g., 127) extends substantially perpendicular to the chest band and divides the chest-covering portion into a first side comprising a first-side knit panel (e.g., 131) and a second side comprising a second-side knit panel (e.g., 133), which is a substantial mirror image of the first-side knit panel. The first-side knit panel includes a series of consecutively arranged interlooping full-length knit courses (e.g., 166) extending substantially parallel to the chest band. Each full-length course has a quantity of stitches consecutively positioned from a medial wale (e.g., first wale 168), which is closer to the garment-midline reference plane on the first side, to a lateral wale (e.g., second wale 170), which is farther from the garment-midline reference plane on the first side. The series of consecutively arranged interlooping full-length knit courses includes a plurality of partial-length knit courses interspersed thereamong forming a dome-shaped knit wall in the first-side knit panel. Each partial-length knit course in the plurality of partial-length knit courses is positioned between the medial wale and the lateral wale and includes a fewer quantity of stitches than each course in the series of consecutively arranged interlooping full length knit courses. The plurality of partial-length knit courses includes a plurality of partial-length-course groupings (e.g., 196, 197, 199, 696, and 698). Each partial-length-course grouping includes one or more longer partial-length courses (e.g., 678A and B in 698) and one or more shorter partial-length courses (e.g., 696A and B in 696). The one or more shorter partial-length courses have fewer consecutive knit stitches than the one or more longer partial-length courses and are spaced apart from the one or more longer partial-length courses by a first quantity (e.g., 661) of full-length courses. Further, each partial-length-course grouping of the plurality is spaced apart from a consecutive partial-length-course grouping by a second quantity (e.g., 665) of full-length courses that is greater than the first quantity.

Another aspect is directed to an upper-torso garment having a front neckline (e.g., 128), a chest band (e.g., 150), and a chest-covering portion (e.g., 129) located between the front neckline and the chest band. A garment-midline reference plane (e.g., 127) extends substantially perpendicular to the chest band and divides the chest-covering portion into a first side comprising a first-side knit panel (e.g., 131) and a second side comprising a second-side knit panel (e.g., 133), which is a substantial mirror image of the first-side knit panel. The first-side knit panel includes a series of consecutively arranged interlooping full-length knit courses (e.g., 166) extending substantially parallel to the chest band. Each full-length course has a quantity of stitches consecutively positioned from a medial wale (e.g., 168), which is closer to the garment-midline reference plane on the first side, to a lateral wale (e.g., 170), which is farther from the garment-midline reference plane on the first side. The series of consecutively arranged interlooping full-length knit courses includes a plurality of partial-length knit courses interspersed thereamong forming an irregular-dome-shaped knit wall (e.g., 232) in the first-side knit panel. Each partial-length knit course in the plurality of partial-length knit courses is positioned between the medial wale and the lateral wale and includes a fewer quantity of stitches than each course in the series of consecutively arranged interlooping full length knit courses. The plurality of partial-length knit courses includes a superior partial-length knit course (e.g., 176) spaced a largest number of courses away from the chest band relative to all other partial-length knit courses in the plurality of partial-length knit courses. In addition, the plurality of partial-length knit courses includes an inferior partial-length knit course (e.g., 178) spaced a fewest number of courses apart from the chest band relative to all other partial-length knit courses in the plurality of partial-length knit courses. A plurality of intermediate partial-length knit courses are arranged between the superior partial-length knit course and the inferior partial-length knit course. In addition, a first dome reference midline (e.g., 180) extends substantially parallel to the chest band and is spaced an even number of courses between the superior partial-length knit course and the inferior partial-length knit course. The first dome reference midline divides an inferior dome portion from a superior dome portion. The plurality of partial-length knit courses includes one or more medial-most knit stitches (e.g., 185) spaced a fewest number of wales from the garment-midline reference plane relative to any other knit stitches included among the plurality of partial-length knit courses. In addition, the plurality of partial-length knit courses includes one or more lateral-most knit stitches (e.g., 187) that are spaced a largest number of wales from the garment-midline reference plane relative to any other knit stitches included among the plurality of partial-length knit courses. A second dome reference midline (e.g., 190) extends perpendicular to the first dome reference midline and is spaced an even number of wales between the one or more medial-most knit stitches and the one or more lateral-most knit stitches. The second dome reference midline divides a medial dome portion (e.g., 192) from a lateral dome portion (e.g., 194). An intersection of the first and second dome reference midlines creates a superior-lateral dome portion (e.g., A), a superior-medial dome portion (e.g., B), an inferior-lateral dome portion (e.g., C), and an inferior-medial dome portion (e.g., D). The inferior-medial dome portion includes a larger concentration of knit stitches that form a portion of the plurality of partial-length knit courses than each of the superior-lateral dome portion, the superior-medial dome portion, and the inferior-lateral dome portion. The plurality of partial-length knit courses includes a plurality of partial-length-course groupings (e.g., 196, 197, 199, 696, 698, 796, and 798). Each partial-length-course grouping includes one or more longer partial-length courses (e.g., 678A and 678B in 698) and one or more shorter partial-length courses (e.g., 675A and 675B in 698). The one or more shorter partial-length courses have fewer consecutive knit stitches than the one or more longer partial-length courses and are spaced apart from the one or more longer partial-length courses by a first quantity (e.g., 661) of full-length courses. Further, each partial-length-course grouping of the plurality is spaced apart from a consecutive partial-length-course grouping by a second quantity (e.g., 665) of full-length courses that is greater than the first quantity.

From the foregoing, it will be seen that this subject matter is adapted to attain ends and objects hereinabove set forth together with other advantages, which are obvious and which are inherent to the structure. It will be understood that certain features and subcombinations are of utility and may be employed without reference to other features and subcombinations. This is contemplated by and is within the scope of the claims. Since many possible variations and alternatives may be made of the subject matter without departing from the scope thereof, it is to be understood that all matter herein set forth or shown in the accompanying drawings is to be interpreted as illustrative and not in a limiting sense.

The invention claimed is:

1. An upper-torso garment comprising:

a dome-shaped knit breast-covering portion comprising a plurality of full-length knit courses and a plurality of partial-length knit courses and including a plurality of knit stitches, wherein each full-length knit course within the plurality of full-length knit courses spans at least a distance from a medial wale to a lateral wale, and wherein a length of each partial-length knit course within the plurality of partial-length knit courses is less than the distance from the medial wale to the lateral wale, and wherein the plurality of partial-length knit courses includes a superior-most course and an inferior-most course;

a first dome reference midline extending substantially parallel to the medial wale or the lateral wale and spaced evenly between the medial wale and the lateral wale; and a second dome reference midline extending substantially perpendicular to the first dome reference midline and spaced evenly between the superior-most course and the inferior-most course, wherein an intersection of the first and second dome reference lines designates a superior-medial quadrant, a superior-lateral quadrant, an inferior-medial quadrant, and an inferior-lateral quadrant, wherein a larger quantity of knit stitches from the plurality of knit stitches is positioned in the inferior-medial quadrant than in each of the superior-medial quadrant, the superior-lateral quadrant, and the inferior-lateral quadrant, wherein the plurality of partial-length knit courses includes a plurality of partial-length-course groupings, each partial-length-course grouping including one or more longer partial-length courses and one or more shorter partial-length courses, and wherein the one or more shorter partial-length courses have fewer consecutive knit stitches than the one or more longer partial-length courses and are spaced apart from the one or more longer partial-length courses by a first quantity of courses.

2. The upper-torso garment of claim 1, wherein the plurality of partial-length courses includes a plurality of medial-most knit stitches located in the medial wale, and wherein the inferior-medial quadrant includes more medial-most knit stitches than a superior-medial quadrant.

3. The upper-torso garment of claim 1, wherein each partial-length-course grouping of the plurality of partial-length-course groupings is spaced apart from a consecutive partial-length-course grouping by a second quantity of courses, and wherein the second quantity of courses is greater than the first quantity of courses.

4. The upper-torso garment of claim 1, wherein the second dome reference midline designates a superior dome portion and an inferior dome portion, and wherein a first plurality of consecutive partial-length-course groupings in the inferior dome portion is spaced apart by a smaller number of courses than a second plurality of consecutive partial-length course groupings in the superior dome portion.

5. The upper-torso garment of claim 3, wherein a ratio of the first quantity of courses to the second quantity of courses is in a range of about 1:2 to about 1:6.

6. The upper-torso garment of claim 1, wherein the dome-shaped knit breast-covering portion includes a double-knit fabric having a front knit layer and a back knit layer, and wherein the front knit layer and the back knit layer are coupled by a binder layer.

7. The upper-torso garment of claim 6, wherein the front knit layer includes a first elastic yarn, the back knit layer includes a second elastic yarn, and the binder layer includes a third elastic yarn.

8. The upper-torso garment of claim 1, wherein the second dome reference midline designates a superior dome portion and an inferior dome portion, and wherein each partial-length-course grouping includes a long-to-short ratio of a number of stitches in each longer partial-length knit course to a number of stitches in each shorter partial-length knit course, and wherein an average long-to-short ratio in the inferior dome portion is greater than an average long-to-short ratio in the superior dome portion.

9. The upper-torso garment of claim 1, wherein the second dome reference midline designates a superior dome portion and an inferior dome portion, wherein in each partial-length-course grouping:

at least one longer partial-length knit course includes a first course midpoint spaced an even distance between a medial-most stitch and a lateral-most stitch of the at least one longer partial-length knit course, and at least one shorter partial-length knit course includes a second course midpoint spaced an even distance between a medial-most stitch and a lateral-most stitch of the at least one shorter partial-length knit course, and wherein, in the inferior dome portion, a plurality of partial-length-course groupings include the first course midpoint being offset towards the medial wale relative to the second course midpoint.

10. The upper-torso garment of claim 1 further comprising, another dome-shaped knit breast-covering portion that is a mirror image of the dome-shaped knit breast-covering portion.

11. The upper-torso garment of claim 1, wherein the second dome reference midline designates a superior dome portion and an inferior dome portion, and wherein the inferior dome portion includes a subset of partial-length knit courses from among the plurality of partial-length knit courses, each partial-length knit course of the subset including a respective medial-most knit stitch, and wherein each of the respective medial-most knit stitches is positioned among a set of five consecutive wales, one of which is the medial wale.

12. The upper-torso garment of claim 11, wherein each of the respective medial-most knit stitches is included among a set of two consecutive wales, one of which is the medial wale.

13. The upper-torso garment of claim 12, wherein the subset spans a first distance comprising a first number of courses, the first distance being at least fifty percent of a second distance comprising a second number of courses between the inferior-most course and the second dome reference midline.

14. The upper-torso garment of claim 13, wherein the first distance is at least ninety percent of the second distance.

15. An upper-torso garment comprising:

a knit dome structure comprising a plurality of full-length courses and a plurality of partial-length knit courses comprising a plurality of knit stitches, each full-length knit course within the plurality of full-length knit courses spanning at least a distance from a medial wale to a lateral wale, and wherein a length of each partial-length knit course within the plurality of partial-length knit courses is less than the distance from the medial wale to the lateral wale; and the knit dome structure comprising a first dome reference midline extending substantially parallel to the medial wale or the lateral wale and spaced evenly between the medial wale and the lateral wale and a second dome reference midline extending substantially perpendicular to the first dome reference midline and spaced evenly between a superior-most course of the plurality of partial-length courses and an inferior-most course of the plurality of partial-length courses.

wherein the knit dome structure further comprises a superior-lateral quadrant, a superior-medial quadrant, an inferior-lateral quadrant, and an inferior-medial quadrant designated by the first dome reference midline and the second dome reference midline, wherein the inferior-medial quadrant includes a larger quantity of knit stitches from the plurality of knit stitches, relative to the superior-lateral quadrant, relative to the superior-medial quadrant, and relative to the inferior-lateral quadrant, wherein an inferior portion of the dome structure includes a subset of partial-length knit courses from among the plurality of partial-length knit courses, each partial-length knit course of the subset including a medial-most knit stitch, and wherein each of the medial-most knit stitches is positioned among a set of five consecutive wales, one of which is the medial wale.

16. The upper-torso garment of claim 15, wherein each of the medial-most knit stitches within the subset is positioned among a set of two consecutive wales, one of which is the medial wale.

17. An upper-torso garment comprising:

a dome-shaped knit breast-covering portion comprising a plurality of full-length knit courses and a plurality of partial-length knit courses, each full-length knit course within the plurality of full-length knit courses spanning at least a distance from a medial wale to a lateral wale, and wherein a length of each partial-length knit course within the plurality of partial-length knit courses is less than the distance from the medial wale to the lateral wale, wherein the plurality of partial-length knit courses includes one or more medial-most knit stitches arranged in the medial wale and one or more lateral-most knit stitches arranged in the lateral wale, and wherein the plurality of partial-length knit courses includes a superior-most course and an inferior-most course;

a first dome reference midline extending substantially parallel to the medial wale or the lateral wale and spaced evenly between the medial wale and the lateral wale; and a second dome reference midline extending substantially perpendicular to the first dome reference midline and spaced evenly between the superior-most course and the inferior-most course, the second dome reference midline designating a superior dome portion and an inferior dome portion, wherein one or more partial-length courses in the inferior portion include a larger number of knit stitches on a medial side of the first dome reference midline than on a lateral side of the first dome reference midline, wherein the plurality of partial-length knit courses includes a plurality of partial-length-course groupings, each partial-length-course grouping including one or more longer partial-length courses and one or more shorter partial-length courses, and wherein the one or more shorter partial-length courses have fewer consecutive knit stitches than the one or more longer partial-length courses and are spaced apart from the one or more longer partial-length courses by a first quantity of courses, and wherein each partial-length-course grouping of the plurality of partial-length-course groupings is spaced apart from a consecutive partial-length-course grouping by a second quantity of courses, and wherein the second quantity of courses is greater than the first quantity of courses.

18. The upper-torso garment of claim 17, wherein the one or more partial-length courses having the larger number of knit stitches on the medial side comprise a subset of partial-length courses, and wherein the subset spans a first distance that is at least fifty percent of a second distance between the inferior-most course and the second dome reference midline.

* * * * *